US007403195B2

(12) United States Patent
Sako et al.

(10) Patent No.: US 7,403,195 B2
(45) Date of Patent: Jul. 22, 2008

(54) METHOD AND APPARATUS FOR DRIVING PASSIVE MATRIX LIQUID CRYSTAL

(75) Inventors: Norimitsu Sako, Chiba (JP); Hideyuki Kitayama, Chiba (JP)

(73) Assignee: Kawasaki Microelectronics, Inc., Chiba (JP)

( * ) Notice: Subject to any disclaimer, the term of this patent is extended or adjusted under 35 U.S.C. 154(b) by 375 days.

(21) Appl. No.: 11/259,070

(22) Filed: Oct. 27, 2005

(65) Prior Publication Data

US 2006/0033693 A1 Feb. 16, 2006

Related U.S. Application Data

(62) Division of application No. 10/415,524, filed on Apr. 30, 2003, now Pat. No. 7,209,129.

(30) Foreign Application Priority Data

Apr. 30, 2002 (JP) ..... 2002-128560

(51) Int. Cl.
*G09G 5/00* (2006.01)

(52) U.S. Cl. ..... 345/204; 345/87; 345/95; 345/98; 345/100; 345/210; 345/212

(58) Field of Classification Search ..... 345/87, 345/95, 98, 100, 204, 210, 212
See application file for complete search history.

(56) References Cited

U.S. PATENT DOCUMENTS 5,262,881 A * 11/1993 Kuwata et al. ..... 345/94
5,420,604 A 5/1995 Scheffer et al.
5,751,379 A 5/1998 Markandey et al.
5,754,157 A * 5/1998 Kuwata et al. ..... 345/100

(Continued)

FOREIGN PATENT DOCUMENTS

DE 100 09 356 A1 11/2000

(Continued)

OTHER PUBLICATIONS

Ruckmongathan, T.N. et al.; *A New Addressing Technique for Fast Responding STN LCDs*; Proceedings of the 12th International Display Research Conf.; Oct. 12-14, 1992; pp. 65-68.

*Primary Examiner*—Bipin Shalwala
*Assistant Examiner*—Vince E Kovalick
(74) *Attorney, Agent, or Firm*—Oliff & Berridge, PLC

(57) ABSTRACT

A method and an apparatus for driving passive matrix liquid crystal, comprising the steps of: simultaneously selecting Y row electrodes, where Y is an odd number of 7 and above; calculating an exclusive OR between a Y-bit row selection vector representing a selection pattern of the Y row electrodes and Y-bit ON/OFF display data representing a display pattern of column electrodes, for each corresponding bit; adding the exclusive ORs for each bit; when X=(Y+1)/2, and a 1/(X−1) voltage of the maximum voltage of the column electrodes is Vc, selecting a voltage level of the column electrodes from X voltage levels satisfying: [2×i−(X−1)]×Vc (i=an integer of 0 to (X−1)) in accordance with the result of the addition for driving. These method and apparatus prevent the frame response phenomenon of high-speed liquid crystal while realizing high-contrast display, low-voltage driving, low power consumption, and reduction in chip size.

10 Claims, 20 Drawing Sheets

U.S. PATENT DOCUMENTS

| | | | | |
|---|---|---|---|---|
| 6,144,373 | A * | 11/2000 | Nakazawa et al. | 345/204 |
| 6,252,573 | B1 * | 6/2001 | Ito et al. | 345/100 |
| 6,320,562 | B1 * | 11/2001 | Ueno et al. | 345/87 |
| 6,340,964 | B1 * | 1/2002 | Nakazawa et al. | 345/100 |
| 6,919,876 | B1 * | 7/2005 | Kawaguchi et al. | 345/103 |
| 2001/0031408 | A1 * | 10/2001 | Ito et al. | 430/47 |

FOREIGN PATENT DOCUMENTS

| | | | |
|---|---|---|---|
| EP | 0 598 913 | A1 | 6/1994 |
| EP | 0 604 226 | A2 | 6/1994 |
| EP | 0 698 874 | A1 | 2/1996 |
| EP | 2000172236 | | 6/2000 |
| JP | A 6-27904 | | 2/1994 |
| JP | A 7-72454 | | 3/1995 |
| JP | A 8-146382 | | 6/1996 |
| JP | A 9-281933 | | 10/1997 |
| JP | A 11-24637 | | 1/1999 |
| JP | A 11-258575 | | 9/1999 |
| JP | A 2000-356766 | | 12/2000 |
| WO | WO 98/10405 | | 3/1998 |

* cited by examiner

FIG. 2

$$M_1 = \begin{pmatrix} 1 & -1 & 1 & -1 & 1 & -1 & 1 & -1 \\ 1 & 1 & -1 & -1 & 1 & 1 & -1 & -1 \\ 1 & -1 & -1 & 1 & 1 & -1 & -1 & 1 \\ 1 & 1 & 1 & 1 & -1 & -1 & -1 & -1 \\ 1 & -1 & 1 & -1 & -1 & 1 & -1 & 1 \\ 1 & 1 & -1 & -1 & -1 & -1 & 1 & 1 \\ 1 & -1 & -1 & 1 & -1 & 1 & 1 & -1 \end{pmatrix}$$

FIG. 6

$$M_2 = \begin{pmatrix} 1 & 1 & -1 & 1 & -1 & 1 & -1 & -1 & -1 & 1 & 1 & -1 \\ 1 & -1 & 1 & -1 & -1 & 1 & 1 & -1 & -1 & -1 & -1 & -1 \\ 1 & -1 & -1 & 1 & 1 & 1 & 1 & 1 & -1 & -1 & 1 & 1 \\ 1 & -1 & 1 & -1 & -1 & -1 & -1 & 1 & -1 & 1 & 1 & 1 \\ 1 & -1 & -1 & -1 & 1 & 1 & -1 & 1 & 1 & 1 & -1 & -1 \\ 1 & -1 & 1 & 1 & 1 & -1 & 1 & -1 & 1 & 1 & 1 & -1 \\ 1 & 1 & -1 & -1 & -1 & -1 & 1 & 1 & 1 & -1 & 1 & -1 \\ 1 & 1 & 1 & -1 & 1 & 1 & -1 & -1 & 1 & -1 & 1 & 1 \\ 1 & 1 & -1 & -1 & 1 & -1 & 1 & -1 & -1 & 1 & -1 & 1 \\ 1 & 1 & 1 & 1 & 1 & -1 & -1 & 1 & -1 & -1 & -1 & -1 \\ 1 & -1 & -1 & 1 & -1 & -1 & -1 & -1 & 1 & -1 & -1 & 1 \end{pmatrix}$$

FIG. 3A
ROW ELECTRODE SELECTION PATTERN

| CYCLE | #1 | #2 | #3 | #4 | #5 | #6 | #7 | #8 |
|---|---|---|---|---|---|---|---|---|
| ROW 1 | -1 | -1 | -1 | -1 | -1 | 1 | -1 | -1 |
| ROW 2 | -1 | -1 | 1 | -1 | 1 | -1 | -1 | 1 |
| ROW 3 | -1 | 1 | -1 | -1 | -1 | -1 | 1 | 1 |
| ROW 4 | 1 | -1 | 1 | -1 | -1 | -1 | 1 | -1 |
| ROW 5 | 1 | -1 | -1 | 1 | -1 | -1 | -1 | 1 |
| ROW 6 | 1 | 1 | -1 | -1 | 1 | -1 | -1 | -1 |
| ROW 7 | -1 | 1 | 1 | 1 | -1 | -1 | -1 | -1 |

FIG. 3B
DISPLAY PATTERN

| R1 | R2 | R3 | R4 | R5 | R6 | R7 |
|---|---|---|---|---|---|---|
| 1 | 1 | 1 | 1 | 1 | 1 | 1 |
| 1 | 1 | 1 | 1 | 1 | 1 | -1 |
| 1 | 1 | 1 | 1 | 1 | -1 | 1 |
| 1 | 1 | 1 | 1 | 1 | -1 | -1 |
| 1 | 1 | 1 | 1 | -1 | 1 | 1 |
| 1 | 1 | 1 | 1 | -1 | 1 | -1 |
| 1 | 1 | 1 | 1 | -1 | -1 | 1 |
| 1 | 1 | 1 | 1 | -1 | -1 | -1 |
| 1 | 1 | 1 | -1 | 1 | 1 | 1 |
| 1 | 1 | 1 | -1 | 1 | 1 | -1 |
| | | ⋮ | ⋮ | ⋮ | | |
| -1 | -1 | -1 | -1 | 1 | 1 | 1 |
| -1 | -1 | -1 | -1 | 1 | 1 | -1 |
| -1 | -1 | -1 | -1 | 1 | -1 | 1 |
| -1 | -1 | -1 | -1 | 1 | -1 | -1 |
| -1 | -1 | -1 | -1 | -1 | 1 | 1 |
| -1 | -1 | -1 | -1 | -1 | 1 | -1 |
| -1 | -1 | -1 | -1 | -1 | -1 | 1 |
| -1 | -1 | -1 | -1 | -1 | -1 | -1 |

FIG. 3C
RESULT OF SUMMATION OF PRODUCTS

| | | | | | | | |
|---|---|---|---|---|---|---|---|
| -1 | -1 | -1 | -3 | -3 | -5 | -3 | -1 |
| 1 | -3 | -3 | -5 | -1 | -3 | -1 | 1 |
| -3 | -3 | 1 | -1 | -5 | -3 | -1 | 1 |
| -1 | -5 | -1 | -3 | -3 | -1 | 1 | 3 |
| -3 | 1 | 1 | -5 | -1 | -3 | -1 | -3 |
| -1 | -1 | -1 | -7 | 1 | -1 | 1 | -1 |
| -5 | -1 | 3 | -3 | -3 | -1 | 1 | -1 |
| -3 | -3 | 1 | -5 | -1 | 1 | 3 | 1 |
| -3 | 1 | -3 | -1 | -1 | -3 | -5 | 1 |
| -1 | -1 | -5 | -3 | 1 | -1 | -3 | 3 |
| | | | ⋮ | ⋮ | ⋮ | | |
| 3 | 3 | -1 | 5 | 1 | -1 | -3 | -1 |
| 5 | 1 | -3 | 3 | 3 | 1 | -1 | 1 |
| 1 | 1 | 1 | 7 | -1 | 1 | -1 | 1 |
| 3 | -1 | -1 | 5 | 1 | 3 | 1 | 3 |
| 1 | 5 | 1 | 3 | 3 | 1 | -1 | -3 |
| 3 | 3 | -1 | 1 | 5 | 3 | 1 | -1 |
| -1 | 3 | 3 | 5 | 1 | 3 | 1 | -1 |
| 1 | 1 | 1 | 3 | 3 | 5 | 3 | 1 |

FIG. 3D
COLUMN ELECTRODE VOLTAGE PATTERN

| | | | | | | | | |
|---|---|---|---|---|---|---|---|---|
| | 1 | 1 | 1 | 1 | 1 | 3 | 1 | 1 |
| | -1 | 1 | 1 | 3 | 1 | 1 | 1 | -1 |
| D1 | 1 | 1 | -1 | 1 | 3 | 1 | 1 | -1 |
| | 1 | 3 | 1 | 1 | 1 | 1 | -1 | -1 |
| | 1 | -1 | -1 | 3 | 1 | 1 | 1 | 1 |
| | 1 | 1 | 1 | 3 | -1 | 1 | -1 | 1 |
| | 3 | 1 | -1 | 1 | 1 | 1 | -1 | 1 |
| | 1 | 1 | -1 | 3 | 1 | -1 | -1 | -1 |
| | 1 | -1 | 1 | 1 | 1 | 1 | 3 | -1 |
| | 1 | 1 | 3 | 1 | -1 | 1 | 1 | -1 |
| | | | | ⋮ | ⋮ | ⋮ | | |
| | -1 | -1 | 1 | -3 | -1 | 1 | 1 | 1 |
| | -3 | -1 | 1 | -1 | -1 | -1 | 1 | -1 |
| | -1 | -1 | -1 | -3 | 1 | -1 | 1 | -1 |
| | -1 | 1 | 1 | -3 | -1 | -1 | -1 | -1 |
| | -1 | -3 | -1 | -1 | -1 | -1 | 1 | 1 |
| | -1 | -1 | 1 | -1 | -3 | -1 | -1 | 1 |
| | 1 | -1 | -1 | -3 | -1 | -1 | -1 | 1 |
| D2 | -1 | -1 | -1 | -1 | -1 | -3 | -1 | -1 |

FIG. 3E
VALUES CORRESPONDING TO EFFECTIVE VOLTAGE

| R1 | R2 | R3 | R4 | R5 | R6 | R7 |
|---|---|---|---|---|---|---|
| 4 | 4 | 4 | 4 | 4 | 4 | 4 |
| 4 | 4 | 4 | 4 | 4 | 4 | -4 |
| 4 | 4 | 4 | 4 | 4 | -4 | 4 |
| 4 | 4 | 4 | 4 | 4 | -4 | -4 |
| 4 | 4 | 4 | 4 | -4 | 4 | 4 |
| 4 | 4 | 4 | 4 | -4 | 4 | -4 |
| 4 | 4 | 4 | 4 | -4 | -4 | 4 |
| 4 | 4 | 4 | 4 | -4 | -4 | -4 |
| 4 | 4 | 4 | -4 | 4 | 4 | 4 |
| 4 | 4 | 4 | -4 | 4 | 4 | -4 |
| | | ⋮ | ⋮ | ⋮ | | |
| -4 | -4 | -4 | -4 | 4 | 4 | 4 |
| -4 | -4 | -4 | -4 | 4 | 4 | -4 |
| -4 | -4 | -4 | -4 | 4 | -4 | 4 |
| -4 | -4 | -4 | -4 | 4 | -4 | -4 |
| -4 | -4 | -4 | -4 | -4 | 4 | 4 |
| -4 | -4 | -4 | -4 | -4 | 4 | -4 |
| -4 | -4 | -4 | -4 | -4 | -4 | 4 |
| -4 | -4 | -4 | -4 | -4 | -4 | -4 |

FIG.7A

ROW ELECTRODE SELECTION PATTERN

| CYCLE | #1 | #2 | #3 | #4 | #5 | #6 | #7 | #8 | #9 | #10 | #11 | #12 |
|---|---|---|---|---|---|---|---|---|---|---|---|---|
| ROW 1 | 1 | 1 | -1 | 1 | 1 | 1 | -1 | -1 | -1 | 1 | -1 | -1 |
| ROW 2 | 1 | -1 | 1 | -1 | 1 | 1 | 1 | -1 | -1 | -1 | 1 | -1 |
| ROW 3 | 1 | -1 | -1 | 1 | -1 | 1 | 1 | 1 | -1 | -1 | -1 | 1 |
| ROW 4 | 1 | 1 | -1 | -1 | 1 | -1 | 1 | 1 | 1 | -1 | -1 | -1 |
| ROW 5 | 1 | -1 | 1 | -1 | -1 | 1 | -1 | 1 | 1 | 1 | -1 | -1 |
| ROW 6 | 1 | -1 | -1 | 1 | -1 | -1 | 1 | -1 | 1 | 1 | 1 | -1 |
| ROW 7 | 1 | -1 | -1 | -1 | 1 | -1 | -1 | 1 | -1 | 1 | 1 | 1 |
| ROW 8 | 1 | 1 | -1 | -1 | -1 | 1 | -1 | -1 | 1 | -1 | 1 | 1 |
| ROW 9 | 1 | 1 | 1 | -1 | -1 | -1 | 1 | -1 | -1 | 1 | -1 | 1 |
| ROW 10 | 1 | 1 | 1 | 1 | -1 | -1 | -1 | 1 | -1 | -1 | 1 | -1 |
| ROW 11 | 1 | -1 | 1 | 1 | 1 | -1 | -1 | -1 | 1 | -1 | -1 | 1 |

FIG.7B

DISPLAY PATTERN

| | R1 | R2 | R3 | R4 | R5 | R6 | R7 | R8 | R9 | R10 | R11 |
|---|---|---|---|---|---|---|---|---|---|---|---|
| * | 1 | 1 | 1 | 1 | 1 | 1 | 1 | 1 | 1 | 1 | 1 |
| | 1 | 1 | 1 | 1 | 1 | 1 | 1 | 1 | 1 | 1 | -1 |
| | 1 | 1 | 1 | 1 | 1 | 1 | 1 | 1 | 1 | -1 | 1 |
| | 1 | 1 | 1 | 1 | 1 | 1 | 1 | 1 | 1 | -1 | -1 |
| | 1 | 1 | 1 | 1 | 1 | 1 | 1 | 1 | -1 | 1 | 1 |
| | 1 | 1 | 1 | 1 | 1 | 1 | 1 | 1 | -1 | 1 | -1 |
| * | 1 | 1 | 1 | 1 | 1 | 1 | 1 | 1 | -1 | -1 | 1 |
| | 1 | 1 | 1 | 1 | 1 | 1 | 1 | 1 | -1 | -1 | -1 |
| | 1 | 1 | 1 | 1 | 1 | 1 | 1 | -1 | 1 | 1 | 1 |
| | 1 | 1 | 1 | 1 | 1 | 1 | 1 | -1 | 1 | 1 | -1 |
| | 1 | 1 | 1 | 1 | 1 | 1 | 1 | -1 | 1 | -1 | 1 |
| | 1 | 1 | 1 | 1 | 1 | 1 | 1 | -1 | 1 | -1 | -1 |
| | 1 | 1 | 1 | 1 | 1 | 1 | 1 | -1 | -1 | 1 | 1 |
| | 1 | 1 | 1 | 1 | 1 | 1 | 1 | -1 | -1 | 1 | -1 |
| | 1 | 1 | 1 | 1 | 1 | 1 | 1 | -1 | -1 | -1 | 1 |
| | 1 | 1 | 1 | 1 | 1 | 1 | 1 | -1 | -1 | -1 | -1 |
| | 1 | 1 | 1 | 1 | 1 | 1 | -1 | 1 | 1 | 1 | 1 |
| | 1 | 1 | 1 | 1 | 1 | 1 | -1 | 1 | 1 | 1 | -1 |
| | 1 | 1 | 1 | 1 | 1 | 1 | -1 | 1 | 1 | -1 | 1 |
| | 1 | 1 | 1 | 1 | 1 | 1 | -1 | 1 | 1 | -1 | -1 |
| | | | | | · | · | · | | | | |
| | | | | | · | · | · | | | | |
| | | | | | · | · | · | | | | |
| | -1 | -1 | -1 | -1 | -1 | -1 | -1 | 1 | 1 | -1 | -1 |
| | -1 | -1 | -1 | -1 | -1 | -1 | -1 | 1 | -1 | 1 | 1 |
| | -1 | -1 | -1 | -1 | -1 | -1 | -1 | 1 | -1 | 1 | -1 |
| | -1 | -1 | -1 | -1 | -1 | -1 | -1 | 1 | -1 | -1 | 1 |
| * | -1 | -1 | -1 | -1 | -1 | -1 | -1 | 1 | -1 | -1 | -1 |
| | -1 | -1 | -1 | -1 | -1 | -1 | -1 | -1 | 1 | 1 | 1 |
| | -1 | -1 | -1 | -1 | -1 | -1 | -1 | -1 | 1 | 1 | -1 |
| | -1 | -1 | -1 | -1 | -1 | -1 | -1 | -1 | 1 | -1 | 1 |
| | -1 | -1 | -1 | -1 | -1 | -1 | -1 | -1 | 1 | -1 | -1 |
| | -1 | -1 | -1 | -1 | -1 | -1 | -1 | -1 | -1 | 1 | 1 |
| | -1 | -1 | -1 | -1 | -1 | -1 | -1 | -1 | -1 | 1 | -1 |
| | -1 | -1 | -1 | -1 | -1 | -1 | -1 | -1 | -1 | -1 | 1 |
| | -1 | -1 | -1 | -1 | -1 | -1 | -1 | -1 | -1 | -1 | -1 |

FIG.7C

RESULT OF SUMMATION OF PRODUCTS

| | | | | | | | | | | | |
|---|---|---|---|---|---|---|---|---|---|---|---|
| 11 | -1 | -1 | -1 | -1 | -1 | -1 | -1 | -1 | -1 | -1 | -1 |
| 9 | 1 | -3 | -3 | -3 | 1 | 1 | 1 | -3 | 1 | 1 | -3 |
| 9 | -3 | -3 | -3 | 1 | 1 | 1 | -3 | 1 | 1 | -3 | 1 |
| 7 | -1 | -5 | -5 | -1 | 3 | 3 | -1 | -1 | 3 | -1 | -1 |
| 9 | -3 | -3 | 1 | 1 | 1 | -3 | 1 | 1 | -3 | 1 | -3 |
| 7 | -1 | -5 | -1 | -1 | 3 | -1 | 3 | -1 | -1 | 3 | -5 |
| 7 | -5 | -5 | -1 | 3 | 3 | -1 | -1 | 3 | -1 | -1 | -1 |
| 5 | -3 | -7 | -3 | 1 | 5 | 1 | 1 | 1 | 1 | 1 | -3 |
| 9 | -3 | 1 | 1 | 1 | -3 | 1 | 1 | -3 | 1 | -3 | -3 |
| 7 | -1 | -1 | -1 | -1 | -1 | 3 | 3 | -5 | 3 | -1 | -5 |
| 7 | -5 | -1 | -1 | 3 | -1 | 3 | -1 | -1 | 3 | -5 | -1 |
| 5 | -3 | -3 | -3 | 1 | 1 | 5 | 1 | -3 | 5 | -3 | -3 |
| 7 | -5 | -1 | 3 | 3 | -1 | -1 | 3 | -1 | -1 | -1 | -5 |
| 5 | -3 | -3 | 1 | 1 | 1 | 1 | 5 | -3 | 1 | 1 | -7 |
| 5 | -7 | -3 | 1 | 5 | 1 | 1 | 1 | 1 | 1 | -3 | -3 |
| 3 | -5 | -5 | -1 | 3 | 3 | 3 | 3 | -1 | 3 | -1 | -5 |
| 9 | 1 | 1 | 1 | -3 | 1 | 1 | -3 | 1 | -3 | -3 | -3 |
| 7 | 3 | -1 | -1 | -5 | 3 | 3 | -1 | -1 | -1 | -1 | -5 |
| 7 | -1 | -1 | -1 | -1 | 3 | 3 | -5 | 3 | -1 | -5 | -1 |
| 5 | 1 | -3 | -3 | -3 | 5 | 5 | -3 | 1 | 1 | -3 | -3 |
| | | | | · | · | · | | | | | |
| | | | | · | · | · | | | | | |
| | | | | · | · | · | | | | | |
| -7 | 5 | 1 | -3 | -3 | 1 | 1 | -3 | 1 | 1 | 1 | 5 |
| -5 | 3 | 3 | 3 | -1 | -1 | -5 | -1 | 3 | -5 | 3 | 3 |
| -7 | 5 | 1 | 1 | -3 | 1 | -3 | 1 | 1 | -3 | 5 | 1 |
| -7 | 1 | 1 | 1 | 1 | 1 | -3 | -3 | 5 | -3 | 1 | 5 |
| -9 | 3 | -1 | -1 | -1 | 3 | -1 | -1 | 3 | -1 | 3 | 3 |
| -5 | 3 | 7 | 3 | -1 | -5 | -1 | -1 | -1 | -1 | -1 | 3 |
| -7 | 5 | 5 | 1 | -3 | -3 | 1 | 1 | -3 | 1 | 1 | 1 |
| -7 | 1 | 5 | 1 | 1 | -3 | 1 | -3 | 1 | 1 | -3 | 5 |
| -9 | 3 | 3 | -1 | -1 | -1 | 3 | -1 | -1 | 3 | -1 | 3 |
| -7 | 1 | 5 | 5 | 1 | -3 | -3 | 1 | 1 | -3 | 1 | 1 |
| -9 | 3 | 3 | 3 | -1 | -1 | -1 | 3 | -1 | -1 | 3 | 1 |
| -9 | -1 | 3 | 3 | 3 | -1 | -1 | -1 | 3 | -1 | -1 | 3 |
| -11 | 1 | 1 | 1 | 1 | 1 | 1 | 1 | 1 | 1 | 1 | 1 |

FIG. 7D

COLUMN ELECTRODE VOLTAGE PATTERN

| | | | | | | | | | | | | |
|---|---|---|---|---|---|---|---|---|---|---|---|---|
| * | -5 | 1 | 1 | 1 | 1 | 1 | 1 | 1 | 1 | 1 | 1 | 1 |
| | -5 | -1 | 1 | 1 | 1 | -1 | -1 | -1 | 1 | -1 | -1 | 1 |
| | -5 | 1 | 1 | 1 | -1 | -1 | -1 | 1 | -1 | -1 | 1 | -1 |
| | -3 | 1 | 3 | 3 | 1 | -1 | -1 | 1 | 1 | -1 | 1 | 1 |
| | -5 | 1 | 1 | -1 | -1 | -1 | 1 | -1 | -1 | 1 | -1 | 1 |
| | -3 | 1 | 3 | 1 | 1 | -1 | 1 | -1 | 1 | 1 | -1 | 3 |
| * | -3 | 3 | 3 | 1 | -1 | -1 | 1 | 1 | -1 | 1 | 1 | 1 |
| | -3 | 1 | 3 | 1 | -1 | -3 | -1 | -1 | -1 | -1 | -1 | 1 |
| | -5 | 1 | -1 | -1 | -1 | 1 | -1 | -1 | 1 | -1 | 1 | 1 |
| | -3 | 1 | 1 | 1 | 1 | 1 | -1 | -1 | 3 | -1 | 1 | 3 |
| | -3 | 3 | 1 | 1 | -1 | 1 | -1 | 1 | 1 | -1 | 3 | 1 |
| | -3 | 1 | 1 | 1 | -1 | -1 | -3 | -1 | 1 | -3 | 1 | 1 |
| | -3 | 3 | 1 | -1 | -1 | 1 | 1 | -1 | 1 | 1 | 1 | 3 |
| | -3 | 1 | 1 | -1 | -1 | -1 | -1 | -3 | 1 | -1 | -1 | 3 |
| | -3 | 3 | 1 | -1 | -3 | -1 | -1 | -1 | -1 | -1 | 1 | 1 |
| | -1 | 3 | 3 | 1 | -1 | -1 | -1 | -1 | 1 | -1 | 1 | 3 |
| | -5 | -1 | -1 | -1 | 1 | -1 | -1 | 1 | -1 | 1 | 1 | 1 |
| | -3 | -1 | 1 | 1 | 3 | -1 | -1 | 1 | 1 | 1 | 1 | 3 |
| | -3 | 1 | 1 | 1 | 1 | -1 | -1 | 3 | -1 | 1 | 3 | 1 |
| | -3 | -1 | 1 | 1 | 1 | -3 | -3 | 1 | -1 | -1 | 1 | 1 |
| | | | | | | ⋮ | ⋮ | ⋮ | | | | |
| | 3 | -3 | -1 | 1 | 1 | -1 | -1 | 1 | -1 | -1 | -1 | -3 |
| | 3 | -1 | -1 | -1 | 1 | 1 | 3 | 1 | -1 | 3 | -1 | -1 |
| | 3 | -3 | -1 | -1 | 1 | -1 | 1 | -1 | -1 | 1 | -3 | -1 |
| | 3 | -1 | -1 | -1 | -1 | -1 | 1 | 1 | -3 | 1 | -1 | -3 |
| * | 5 | -1 | 1 | 1 | 1 | -1 | 1 | 1 | -1 | 1 | -1 | -1 |
| | 3 | -1 | -3 | -1 | 1 | 3 | 1 | 1 | 1 | 1 | 1 | -1 |
| | 3 | -3 | -3 | -1 | 1 | 1 | -1 | -1 | 1 | -1 | -1 | -1 |
| | 3 | -1 | -3 | -1 | -1 | 1 | -1 | 1 | -1 | -1 | 1 | -3 |
| | 5 | -1 | -1 | 1 | 1 | 1 | -1 | 1 | 1 | -1 | 1 | -1 |
| | 3 | -1 | -3 | -3 | -1 | 1 | 1 | -1 | -1 | 1 | -1 | -1 |
| | 5 | -1 | -1 | -1 | 1 | 1 | 1 | -1 | 1 | 1 | -1 | 1 |
| | 5 | 1 | -1 | -1 | -1 | 1 | 1 | 1 | -1 | 1 | 1 | -1 |
| | 5 | -1 | -1 | -1 | -1 | -1 | -1 | -1 | -1 | -1 | -1 | -1 |

FIG. 7E

VALUES CORRESPONDING TO EFFECTIVE VOLTAGE

| R1 | R2 | R3 | R4 | R5 | R6 | R7 | R8 | R9 | R10 | R11 |
|---|---|---|---|---|---|---|---|---|---|---|
| 6 | 6 | 6 | 6 | 6 | 6 | 6 | 6 | 6 | 6 | 6 |
| 6 | 6 | 6 | 6 | 6 | 6 | 6 | 6 | 6 | 6 | -6 |
| 6 | 6 | 6 | 6 | 6 | 6 | 6 | 6 | 6 | -6 | 6 |
| 6 | 6 | 6 | 6 | 6 | 6 | 6 | 6 | 6 | -6 | -6 |
| 6 | 6 | 6 | 6 | 6 | 6 | 6 | 6 | -6 | 6 | 6 |
| 6 | 6 | 6 | 6 | 6 | 6 | 6 | 6 | -6 | 6 | -6 |
| 6 | 6 | 6 | 6 | 6 | 6 | 6 | 6 | -6 | -6 | 6 |
| 6 | 6 | 6 | 6 | 6 | 6 | 6 | 6 | -6 | -6 | -6 |
| 6 | 6 | 6 | 6 | 6 | 6 | 6 | -6 | 6 | 6 | 6 |
| 6 | 6 | 6 | 6 | 6 | 6 | 6 | -6 | 6 | 6 | -6 |
| 6 | 6 | 6 | 6 | 6 | 6 | 6 | -6 | 6 | -6 | 6 |
| 6 | 6 | 6 | 6 | 6 | 6 | 6 | -6 | 6 | -6 | -6 |
| 6 | 6 | 6 | 6 | 6 | 6 | 6 | -6 | -6 | 6 | 6 |
| 6 | 6 | 6 | 6 | 6 | 6 | 6 | -6 | -6 | 6 | -6 |
| 6 | 6 | 6 | 6 | 6 | 6 | 6 | -6 | -6 | -6 | 6 |
| 6 | 6 | 6 | 6 | 6 | 6 | 6 | -6 | -6 | -6 | -6 |
| 6 | 6 | 6 | 6 | 6 | 6 | -6 | 6 | 6 | 6 | 6 |
| 6 | 6 | 6 | 6 | 6 | 6 | -6 | 6 | 6 | 6 | -6 |
| 6 | 6 | 6 | 6 | 6 | 6 | -6 | 6 | 6 | -6 | 6 |
| 6 | 6 | 6 | 6 | 6 | 6 | -6 | 6 | 6 | -6 | -6 |
| | | | | ⋮ | ⋮ | ⋮ | | | | |
| -6 | -6 | -6 | -6 | -6 | -6 | -6 | 6 | 6 | -6 | -6 |
| -6 | -6 | -6 | -6 | -6 | -6 | -6 | 6 | -6 | 6 | 6 |
| -6 | -6 | -6 | -6 | -6 | -6 | -6 | 6 | -6 | 6 | -6 |
| -6 | -6 | -6 | -6 | -6 | -6 | -6 | 6 | -6 | -6 | 6 |
| -6 | -6 | -6 | -6 | -6 | -6 | -6 | 6 | -6 | -6 | -6 |
| -6 | -6 | -6 | -6 | -6 | -6 | -6 | -6 | 6 | 6 | 6 |
| -6 | -6 | -6 | -6 | -6 | -6 | -6 | -6 | 6 | 6 | -6 |
| -6 | -6 | -6 | -6 | -6 | -6 | -6 | -6 | 6 | -6 | 6 |
| -6 | -6 | -6 | -6 | -6 | -6 | -6 | -6 | 6 | -6 | -6 |
| -6 | -6 | -6 | -6 | -6 | -6 | -6 | -6 | -6 | 6 | 6 |
| -6 | -6 | -6 | -6 | -6 | -6 | -6 | -6 | -6 | 6 | -6 |
| -6 | -6 | -6 | -6 | -6 | -6 | -6 | -6 | -6 | -6 | 6 |
| -6 | -6 | -6 | -6 | -6 | -6 | -6 | -6 | -6 | -6 | -6 |

FIG. 9A

ROW ELECTRODE SELECTION PATTERN

| CYCLE | #1 | #2 | #3 | #4 | #5 | #6 | #7 | #8 | #9 | #10 | #11 | #12 |
|---|---|---|---|---|---|---|---|---|---|---|---|---|
| ROW 1 | 1 | 1 | -1 | 1 | 1 | 1 | -1 | -1 | -1 | 1 | -1 | -1 |
| ROW 2 | 1 | -1 | 1 | -1 | 1 | 1 | 1 | -1 | -1 | -1 | 1 | -1 |
| ROW 3 | 1 | -1 | -1 | 1 | -1 | 1 | 1 | 1 | -1 | -1 | -1 | 1 |
| ROW 4 | 1 | 1 | -1 | -1 | 1 | -1 | 1 | 1 | 1 | -1 | -1 | -1 |
| ROW 5 | 1 | -1 | 1 | -1 | -1 | 1 | -1 | 1 | 1 | 1 | -1 | -1 |
| ROW 6 | 1 | -1 | -1 | 1 | -1 | -1 | 1 | -1 | 1 | 1 | 1 | -1 |
| ROW 7 | 1 | -1 | -1 | -1 | 1 | -1 | -1 | 1 | -1 | 1 | 1 | 1 |
| ROW 8 | 1 | 1 | -1 | -1 | -1 | 1 | -1 | -1 | 1 | -1 | 1 | 1 |
| ROW 9 | 1 | 1 | 1 | -1 | -1 | -1 | 1 | -1 | -1 | 1 | -1 | 1 |
| ROW 10 | 1 | 1 | 1 | 1 | -1 | -1 | -1 | 1 | -1 | -1 | 1 | -1 |
| ROW 11 | 1 | -1 | 1 | 1 | 1 | -1 | -1 | -1 | 1 | -1 | -1 | 1 |

FIG. 9B

DISPLAY PATTERN

| R1 | R2 | R3 | R4 | R5 | R6 | R7 | R8 | R9 | R10 | R11 |
|---|---|---|---|---|---|---|---|---|---|---|
| 1 | 1 | 1 | 1 | 1 | 1 | 1 | 1 | 1 | 1 | 1 |
| 1 | 1 | 1 | 1 | 1 | 1 | 1 | 1 | -1 | -1 | 1 |
| -1 | -1 | -1 | -1 | -1 | -1 | -1 | 1 | -1 | -1 | -1 |

FIG. 9C

RESULT OF SUMMATION OF PRODUCTS

| | | | | | | | | | | | |
|---|---|---|---|---|---|---|---|---|---|---|---|
| 11 | -1 | -1 | -1 | -1 | -1 | -1 | -1 | -1 | -1 | -1 | -1 |
| 7 | -5 | -5 | -1 | 3 | 3 | -1 | -1 | 3 | -1 | -1 | -1 |
| -9 | 3 | -1 | -1 | -1 | 3 | -1 | -1 | 3 | -1 | 3 | 3 |

FIG. 9D

COLUMN ELECTRODE VOLTAGE PATTERN

| | | | | | | | | | | | |
|---|---|---|---|---|---|---|---|---|---|---|---|
| -5 | 1 | 1 | 1 | 1 | 1 | 1 | 1 | 1 | 1 | 1 | 1 |
| -3 | 3 | 3 | 1 | -1 | -1 | 1 | 1 | -1 | 1 | 1 | 1 |
| 5 | -1 | 1 | 1 | 1 | -1 | 1 | 1 | -1 | 1 | -1 | -1 |

FIG. 9E

VALUES CORRESPONDING TO EFFECTIVE VOLTAGE

| R1 | R2 | R3 | R4 | R5 | R6 | R7 | R8 | R9 | R10 | R11 |
|---|---|---|---|---|---|---|---|---|---|---|
| 6 | 6 | 6 | 6 | 6 | 6 | 6 | 6 | 6 | 6 | 6 |
| 6 | 6 | 6 | 6 | 6 | 6 | 6 | 6 | -6 | -6 | 6 |
| -6 | -6 | -6 | -6 | -6 | -6 | -6 | 6 | -6 | -6 | -6 |

FIG. 20
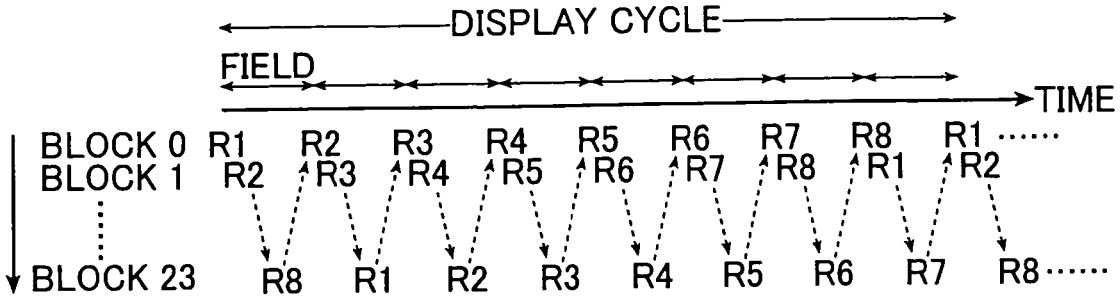
FIG. 21
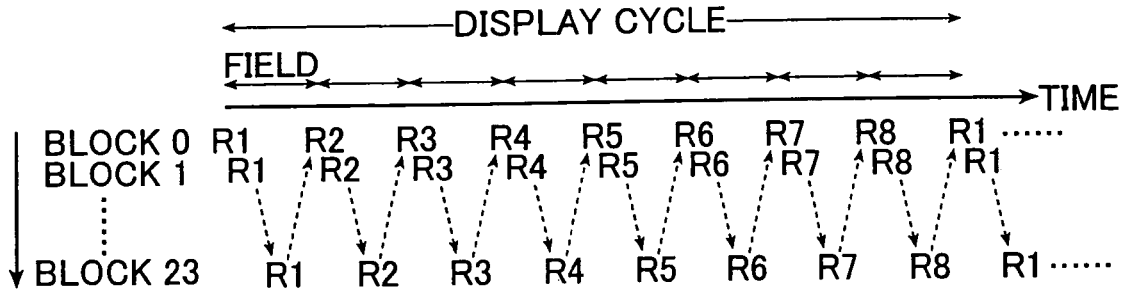
FIG. 22
| | | #1 | #2 | #3 | #4 | #5 | #6 | #7 | #8 | |
|---|---|---|---|---|---|---|---|---|---|---|
| | | R1 | R2 | R3 | R4 | R5 | R6 | R7 | R8 | |
| ROW ELECTRODE 1 | L1 | 1 | 1 | 1 | 1 | −1 | −1 | −1 | −1 | ← BRIGHT |
| ROW ELECTRODE 2 | L2 | 1 | 1 | −1 | −1 | −1 | −1 | 1 | 1 | |
| ROW ELECTRODE 3 | L3 | 1 | 1 | −1 | −1 | 1 | 1 | −1 | −1 | |
| ROW ELECTRODE 4 | L4 | 1 | −1 | −1 | 1 | 1 | −1 | −1 | 1 | |
| ROW ELECTRODE 5 | L5 | 1 | −1 | −1 | 1 | −1 | 1 | 1 | −1 | |
| ROW ELECTRODE 6 | L6 | 1 | −1 | 1 | −1 | −1 | 1 | −1 | 1 | |
| ROW ELECTRODE 7 | L7 | 1 | −1 | 1 | −1 | 1 | −1 | 1 | −1 | |

FIG. 23

ORTHOGONAL FUNCTION A

| | | #1 | #2 | #3 | #4 | #5 | #6 | #7 | #8 |
|---|---|---|---|---|---|---|---|---|---|
| | | R1 | R2 | R3 | R4 | R5 | R6 | R7 | R8 |
| ROW ELECTRODE 1 | L1 | 1 | 1 | 1 | 1 | −1 | −1 | −1 | −1 |
| ROW ELECTRODE 2 | L2 | 1 | 1 | −1 | −1 | −1 | −1 | 1 | 1 |
| ROW ELECTRODE 3 | L3 | 1 | 1 | −1 | −1 | 1 | 1 | −1 | −1 |
| ROW ELECTRODE 4 | L4 | 1 | −1 | −1 | 1 | 1 | −1 | −1 | 1 |
| ROW ELECTRODE 5 | L5 | 1 | −1 | −1 | 1 | −1 | 1 | 1 | −1 |
| ROW ELECTRODE 6 | L6 | 1 | −1 | 1 | −1 | −1 | 1 | −1 | 1 |
| ROW ELECTRODE 7 | L7 | 1 | −1 | 1 | −1 | 1 | −1 | 1 | −1 |

ORTHOGONAL FUNCTION B

| | | #1 | #2 | #3 | #4 | #5 | #6 | #7 | #8 |
|---|---|---|---|---|---|---|---|---|---|
| | | R1 | R2 | R3 | R4 | R5 | R6 | R7 | R8 |
| ROW ELECTRODE 1 | L6 | 1 | −1 | 1 | −1 | −1 | 1 | −1 | 1 |
| ROW ELECTRODE 2 | L7 | 1 | −1 | 1 | −1 | 1 | −1 | 1 | −1 |
| ROW ELECTRODE 3 | L1 | 1 | 1 | 1 | 1 | −1 | −1 | −1 | −1 |
| ROW ELECTRODE 4 | L2 | 1 | 1 | −1 | −1 | −1 | −1 | 1 | 1 |
| ROW ELECTRODE 5 | L3 | 1 | 1 | −1 | −1 | 1 | 1 | −1 | −1 |
| ROW ELECTRODE 6 | L4 | 1 | −1 | −1 | 1 | 1 | −1 | −1 | 1 |
| ROW ELECTRODE 7 | L5 | 1 | −1 | −1 | 1 | −1 | 1 | 1 | −1 |

ORTHOGONAL FUNCTION C

| | | #1 | #2 | #3 | #4 | #5 | #6 | #7 | #8 |
|---|---|---|---|---|---|---|---|---|---|
| | | R1 | R2 | R3 | R4 | R5 | R6 | R7 | R8 |
| ROW ELECTRODE 1 | L4 | 1 | −1 | −1 | 1 | 1 | −1 | −1 | 1 |
| ROW ELECTRODE 2 | L5 | 1 | −1 | −1 | 1 | −1 | 1 | 1 | −1 |
| ROW ELECTRODE 3 | L6 | 1 | −1 | 1 | −1 | −1 | 1 | −1 | 1 |
| ROW ELECTRODE 4 | L7 | 1 | −1 | 1 | −1 | 1 | −1 | 1 | −1 |
| ROW ELECTRODE 5 | L1 | 1 | 1 | 1 | 1 | −1 | −1 | −1 | −1 |
| ROW ELECTRODE 6 | L2 | 1 | 1 | −1 | −1 | −1 | −1 | 1 | 1 |
| ROW ELECTRODE 7 | L3 | 1 | 1 | −1 | −1 | 1 | 1 | −1 | −1 |

ORTHOGONAL FUNCTION D

| | | #1 | #2 | #3 | #4 | #5 | #6 | #7 | #8 |
|---|---|---|---|---|---|---|---|---|---|
| | | R1 | R2 | R3 | R4 | R5 | R6 | R7 | R8 |
| ROW ELECTRODE 1 | L2 | 1 | 1 | −1 | −1 | −1 | −1 | 1 | 1 |
| ROW ELECTRODE 2 | L3 | 1 | 1 | −1 | −1 | 1 | 1 | −1 | −1 |
| ROW ELECTRODE 3 | L4 | 1 | −1 | −1 | 1 | 1 | −1 | −1 | 1 |
| ROW ELECTRODE 4 | L5 | 1 | −1 | −1 | 1 | −1 | 1 | 1 | −1 |
| ROW ELECTRODE 5 | L6 | 1 | −1 | 1 | −1 | −1 | 1 | −1 | 1 |
| ROW ELECTRODE 6 | L7 | 1 | −1 | 1 | −1 | 1 | −1 | 1 | −1 |
| ROW ELECTRODE 7 | L1 | 1 | 1 | 1 | 1 | −1 | −1 | −1 | −1 |

ORTHOGONAL FUNCTION E

| | | #1 | #2 | #3 | #4 | #5 | #6 | #7 | #8 |
|---|---|---|---|---|---|---|---|---|---|
| | | R1 | R2 | R3 | R4 | R5 | R6 | R7 | R8 |
| ROW ELECTRODE 1 | L7 | 1 | −1 | 1 | −1 | 1 | −1 | 1 | −1 |
| ROW ELECTRODE 2 | L1 | 1 | 1 | 1 | 1 | −1 | −1 | −1 | −1 |
| ROW ELECTRODE 3 | L2 | 1 | 1 | −1 | −1 | −1 | −1 | 1 | 1 |
| ROW ELECTRODE 4 | L3 | 1 | 1 | −1 | −1 | 1 | 1 | −1 | −1 |
| ROW ELECTRODE 5 | L4 | 1 | −1 | −1 | 1 | 1 | −1 | −1 | 1 |
| ROW ELECTRODE 6 | L5 | 1 | −1 | −1 | 1 | −1 | 1 | 1 | −1 |
| ROW ELECTRODE 7 | L6 | 1 | −1 | 1 | −1 | −1 | 1 | −1 | 1 |

ORTHOGONAL FUNCTION F

| | | #1 | #2 | #3 | #4 | #5 | #6 | #7 | #8 |
|---|---|---|---|---|---|---|---|---|---|
| | | R1 | R2 | R3 | R4 | R5 | R6 | R7 | R8 |
| ROW ELECTRODE 1 | L5 | 1 | −1 | −1 | 1 | −1 | 1 | 1 | −1 |
| ROW ELECTRODE 2 | L6 | 1 | −1 | 1 | −1 | −1 | 1 | −1 | 1 |
| ROW ELECTRODE 3 | L7 | 1 | −1 | 1 | −1 | 1 | −1 | 1 | −1 |
| ROW ELECTRODE 4 | L1 | 1 | 1 | 1 | 1 | −1 | −1 | −1 | −1 |
| ROW ELECTRODE 5 | L2 | 1 | 1 | −1 | −1 | −1 | −1 | 1 | 1 |
| ROW ELECTRODE 6 | L3 | 1 | 1 | −1 | −1 | 1 | 1 | −1 | −1 |
| ROW ELECTRODE 7 | L4 | 1 | −1 | −1 | 1 | 1 | −1 | −1 | 1 |

ORTHOGONAL FUNCTION G

| | | #1 | #2 | #3 | #4 | #5 | #6 | #7 | #8 |
|---|---|---|---|---|---|---|---|---|---|
| | | R1 | R2 | R3 | R4 | R5 | R6 | R7 | R8 |
| ROW ELECTRODE 1 | L3 | 1 | 1 | −1 | −1 | 1 | 1 | −1 | −1 |
| ROW ELECTRODE 2 | L4 | 1 | −1 | −1 | 1 | 1 | −1 | −1 | 1 |
| ROW ELECTRODE 3 | L5 | 1 | −1 | −1 | 1 | −1 | 1 | 1 | −1 |
| ROW ELECTRODE 4 | L6 | 1 | −1 | 1 | −1 | −1 | 1 | −1 | 1 |
| ROW ELECTRODE 5 | L7 | 1 | −1 | 1 | −1 | 1 | −1 | 1 | −1 |
| ROW ELECTRODE 6 | L1 | 1 | 1 | 1 | 1 | −1 | −1 | −1 | −1 |
| ROW ELECTRODE 7 | L2 | 1 | 1 | −1 | −1 | −1 | −1 | 1 | 1 |

FIG.24

ROW SELECTION TIME PERIOD

| | DIVIDED SELECTION TIME PERIOD A | | DIVIDED SELECTION TIME PERIOD B | | DIVIDED SELECTION TIME PERIOD C | | DIVIDED SELECTION TIME PERIOD D | | DIVIDED SELECTION TIME PERIOD E | | DIVIDED SELECTION TIME PERIOD F | | DIVIDED SELECTION TIME PERIOD G | |
|---|---|---|---|---|---|---|---|---|---|---|---|---|---|---|
| SEQUENCE | 0 | 1 | 2 | 3 | 4 | 5 | 6 | 7 | 8 | 9 | 10 | 11 | 12 | 13 |
| ROW ELECTRODE 1 | L1 | L1 | L6 | L6 | L4 | L4 | L2 | L2 | L7 | L7 | L5 | L5 | L3 | L3 |
| ROW ELECTRODE 2 | L2 | L2 | L7 | L7 | L5 | L5 | L3 | L3 | L1 | L1 | L6 | L6 | L4 | L4 |
| ROW ELECTRODE 3 | L3 | L3 | L1 | L1 | L6 | L6 | L4 | L4 | L2 | L2 | L7 | L7 | L5 | L5 |
| ROW ELECTRODE 4 | L4 | L4 | L2 | L2 | L7 | L7 | L5 | L5 | L3 | L3 | L1 | L1 | L6 | L6 |
| ROW ELECTRODE 5 | L5 | L5 | L3 | L3 | L1 | L1 | L6 | L6 | L4 | L4 | L2 | L2 | L7 | L7 |
| ROW ELECTRODE 6 | L6 | L6 | L4 | L4 | L2 | L2 | L7 | L7 | L5 | L5 | L3 | L3 | L1 | L1 |
| ROW ELECTRODE 7 | L7 | L7 | L5 | L5 | L3 | L3 | L1 | L1 | L6 | L6 | L4 | L4 | L2 | L2 |

METHOD AND APPARATUS FOR DRIVING PASSIVE MATRIX LIQUID CRYSTAL

The present application is a Divisional Application of U.S. patent application Ser. No. 10/415,524 filed Apr. 30, 2003, which is hereby expressly incorporated by reference herein in its entirety.

TECHNICAL FIELD

The present invention relates to a method and a apparatus for driving passive matrix liquid crystal, in particular, to multiline addressing (MLA) drive method and apparatus for passive matrix liquid crystal, which employ an MLA drive system, a drive method and a liquid crystal driving apparatus for passive matrix liquid crystal, which employ an MLA drive system with the addition of an FRC (frame rate control) gradation system to a PWM (pulse width modulation) gradation system, to display a multi-gradation color motion picture on the passive matrix liquid crystal, and multiline addressing drive method and apparatus for passive matrix liquid crystal, which allow the elimination of horizontal brightness unevenness peculiar to an MLA drive system so as to enable high-quality display.

BACKGROUND ART

Conventionally, a liquid crystal display (hereinafter, referred to as LCD) has been used as a display apparatus for a word processor or a personal computer. Due to its capability of easy miniaturization and its advantages of being thin, lightweight, and the like, the LCD has been more and more frequently used in these days, for example, as a display of a portable telephone and the like.

As a type of the LCDs, there exists a passive matrix type LCD for driving so-called Twisted Nematic type (TN type) liquid crystal display device and Super Twisted Nematic type (STN type) liquid crystal display device without using any thin-film transistor. Besides a conventional line sequential scanning system (duty system) such as an APT (Alt Pleshko Technique) drive system, or an IAPT (Improved APT) system, which is obtained by improving the APT system, various drive systems are conceived as systems for driving these LCDs.

In contrast with such a conventional line sequential scanning system, a multiline addressing drive system (MLA drive system), which is a multiline simultaneous drive system for simultaneously selecting and driving a plurality of scanning lines, has also been proposed.

For example, JP 6-27904 A discloses an example of the MLA drive system, called a Multi-Line Selection (MLS) drive system. More specifically, this drive system is for selecting L row electrodes at a time. A selection voltage for the row electrodes has either a +Vr voltage level or a −Vr voltage level, K is a power of 2 being L or more, and a column vector element of a K-th orthogonal matrix corresponds to the voltage level. Then, assuming that the total sum of exclusive ORs of corresponding elements between a data vector of ON/OFF display data and a selection voltage vector is i, i is an integer of any one of 0 to L. Voltage values Vi at the level of (L+1) are applied to the column electrodes.

Moreover, JP 11-258575 discloses an example of the MLA drive system, called a BLA3 (Bi-Level Addressing 3) drive system. In this system, three row electrodes are simultaneously selected. A selection voltage for the row electrodes has two voltage levels, that is, +Vr and −Vr. The selection voltage corresponds to column vector elements of three rows and four columns obtained by excluding one row from a fourth orthogonal matrix. The column electrodes are driven by applying two voltage levels: if the total sum of products of corresponding elements between data vector of ON/OFF display data and selection voltage vector is positive, a voltage level corresponding to −1 is applied; if it is negative, a voltage level corresponding to +1 is applied.

Recently, however, the colorization of an LCD panel (liquid crystal display apparatus), which is used as display means in a personal computer, a personal digital assistance, a portable telephone, or the like, has been more and more improved, so that 4K colors, 65K colors and the like have been put into practical use. On the other hand, the attempt of mounting LCD drivers on a single chip is now under development for reducing the cost. However, the area of a display data memory is increased along with the improvement in colorization, resulting in a dilemma that a fine-process with high voltage tolerance should be realized.

For example, the above-mentioned conventional LCD driving systems have the following problems.

More specifically, in the drive system described in JP 6-27904 A, as the number L of row electrodes to be selected at a time is increased, the selection voltage (+Vr, −Vr) can be lowered. However, (L+1) voltage levels are required for the column electrodes. For example, in the case of L=8, L+1=9 voltage levels are required for the column electrodes. As a result, a power source circuit is complicated to disadvantageously increase the size of a driver circuit of the column electrodes.

On the other hand, in the drive system described in JP 11-258575, since the voltage level for the column electrodes has two values, the size of a driver circuit can be reduced. However, the selection voltage cannot be lowered with L=3. In this manner, this drive system is not suitable for a fine-process for its high selection voltage, and therefore is not useful for mounting a driver circuit on one chip. Thus, there is a problem in that the BLA3 drive system is also no more suitable for applications such as a portable telephone.

Furthermore, as described above, the LCD panel is required to display a multi-gradation image with high definition along with its improvement in colorization. At the same time, there is a growing demand for the LCD panel to display full motion pictures.

The known gradation driving systems for multi-gradation display are roughly classified into two types; an FRC (Frame Rate Control) gradation system and a PWM (Pulse Width Modulation) gradation system.

The FRC gradation system uses a plurality of frames to display a single display image. In this system, the frequency of ON/OFF operations is controlled by a voltage to be applied to a liquid crystal device in each frame period so as to express the gradations of a display image.

Also, the PWM gradation system divides one frame period into an ON period and an OFF period so as to express the gradations of a display image. More specifically, the PWM gradation system can be considered as a system for executing the FRC gradation system within one frame.

Moreover, it is necessary to update the display image data of at least 30 frames or more for a second so as to display a motion picture (full motion picture). In order to realize such update, image data should be transferred for each frame, and therefore, it is necessary to overwrite a memory at high speed.

Furthermore, with the increase in number of gradations, the amount of data is also increased. Accordingly, higher speed is required, leading to increased power consumption. Therefore, it is required to restrain the power consumption to be as small as possible so that the power consumption is not increased even if the speed is increased.

Conventionally, as a method of realizing the multi-gradation, for example, JP 11-24637 A discloses the combination of the PWM gradation system and the FRC gradation system for displaying a natural image at 64-gradations or more on a passive matrix liquid crystal display apparatus equipped with a large screen.

In this system, each column voltage is unevenly divided into two sections. In each frame period, the multi-gradation is expressed in the PWM gradation system. The FRC gradation system is combined with the PWM gradation method so that one image is updated in each cycle consisting of a plurality of frames, each frame corresponding to the PWM gradation, thereby constituting the multi-gradation.

For realizing such gradation expression, both column voltage control and phase frame control are employed. The column voltage control is for variably controlling a column voltage in accordance with a series of column voltage sequences which are applied to a predetermined liquid crystal device so as to display a predetermined gradation. More specifically, in the case where a series of column voltage sequences to be applied to a predetermined liquid crystal device or column electrode are all smaller than a pulse width which can be allocated to the column voltages, for example, the column voltages are increased by 5% so as to compensate for the lowered brightness due to a high frequency.

The phase frame control is for controlling a phase so that a mean brightness of a plurality of brightnesses becomes approximately uniform over a plurality of frames in the FRC gradation system.

Furthermore, the system disclosed in the above-described JP 11-24637 A controls the absolute values of the respective column voltages of a series of column voltage sequences to be all the same so as to restrain the generation of splicing, that is, transient brightness offset.

Also, as a conventional apparatus for displaying a motion picture, for example, JP 9-281933 A discloses a liquid crystal display screen (liquid crystal panel) equipped with a static picture display area and a motion picture display area. The switching is performed between static picture data transmitted from a CPU and the like and motion picture data transmitted from a motion picture controller so as to output the data to the liquid crystal panel.

In this method, the display data (static picture data) from an external data bus is stored into a display memory included therein. The display is performed while switching between an output data bus for sequentially reading out the static data from the display memory and an external data bus carrying display data (motion picture data) from an external motion picture controller, whereby the power consumption is intended to be reduced.

In the method disclosed in the above-mentioned Patent Publication, the gradation display is performed by any one of the FRC system, the PWM system, an AM (amplitude modulation) system, or the combination thereof.

In the gradations obtained by the combination of the PWM system and the FRC system, in particular, each gradation obtained by the PWM for dividing a selection time period of row electrodes (hereinafter, row selection time period) is arranged in a series for each frame to achieve the multi-gradation.

However, in a STN (super twisted nematic) LCD driver compatible to display of a full motion picture obtained by switching at least 30 or more frames on the screen for each second, if the multi-gradation display is intended to be realized by the PWM system alone, the frequency of a column signal becomes higher. As a result, there arises a problem in that the LCD panel cannot respond to such a high frequency. This is mainly caused by a resistance component of transparent electrodes and a capacitance component of liquid crystal between the transparent electrodes.

Moreover, similarly to the method disclosed in the above-mentioned JP 11-24637 A, even if the column-divided PWM is combined with the FRC system to realize the multi-gradation, the amount gradually reduced by the column-divided PWM is gradually increased by the FRC. Therefore, there are problems that a column signal has similarly a higher frequency and that a column selection time period is gradually reduced.

In a conventional duty drive system, a frame response phenomenon is primarily generated in high-speed liquid crystal. Since the high-speed driving is performed in the motion picture display as described above, there is a problem that the contrast is disadvantageously lowered due to the frame response phenomenon. In the MLA drive system, the number of selections for each unit time is increased as compared with that in the duty drive system. However, the same problem arises for a higher frequency.

In the system disclosed in the above-mentioned JP 9-281933 A, for switching between the motion picture data from the exterior and the static picture data present inside, the electric power is consumed in the exterior. There is a problem in that the presence of a plurality of chips increases the cost.

Furthermore, the MLA drive system has a problem in that the brightness unevenness is generated in a horizontal direction. This horizontal brightness unevenness is sometimes referred to as a COM stripe because it is a stripe generated in a row electrode (COMMON electrode) direction.

On the other hand, the column voltage control disclosed in the above-mentioned JP 11-24637 A does not serve as an effective solution for the horizontal brightness unevenness. The column voltage is determined by the result of an MLA calculation (exclusive OR and addition) between ON/OFF display data and an orthogonal function. Therefore, if it is intended to predict a series of column voltage sequences over frames so as to determine whether the column voltage is to be increased or not, the circuit is extremely complicated. Thus, such a solution is not practical.

The invention disclosed in the above-mentioned JP 11-24637 has an object of attenuating a high frequency component of the column voltage sequence by a resistance component of the column electrode and a capacitance component of each liquid crystal. In this case, however, the brightness unevenness appears in a direction of the column electrode (normally, in a longitudinal direction). Therefore, it is believed that such a phenomenon differs from the brightness unevenness (COM stripe) appearing in the direction of the row electrode (normally, in a horizontal direction), which is regarded as a problem in the present invention. Although the reason for occurrence of the horizontal brightness unevenness is not elucidated, it is supposed that such brightness unevenness is caused due to optical response characteristics depending on a pattern of a row electrode voltage and a column electrode voltage applied to liquid crystal in time sequence. Therefore, the above-mentioned related art cannot solve the problem of the horizontal brightness unevenness.

DISCLOSURE OF THE INVENTION

In view of the above conventional problems, the present invention has a first object of providing multiline addressing drive method and apparatus for passive matrix liquid crystal, capable of preventing the occurrence of a frame response phenomenon of high-speed liquid crystal while realizing the high contrast display, the driving at a low voltage, the reduced power consumption and the reduction in chip size.

In view of the above conventional problems, the present invention has a second object of providing a drive method and a liquid crystal driving apparatus for passive matrix liquid, capable of displaying a letter, a slow motion picture, or a static picture at multi-gradation levels in passive matrix liquid crystal such as STN liquid crystal and of restraining the drop in contrast, the increase in power consumption, the splicing, and the reduction in color reproducibility to display a multi-gradation full motion picture.

In view of the above conventional problems, the present invention has a third object of providing multiline addressing (MLA) drive method and apparatus for passive matrix liquid, capable of eliminating the brightness unevenness generated in a horizontal direction, which is peculiar to the MLA drive system, so as to improve the display quality of an LCD, in the MLA drive system for simultaneously driving a plurality of rows of passive matrix liquid crystal by using an orthogonal function.

In order to attain the above-mentioned first object, according to a first mode of a first aspect of the present invention, there is provided a multiline addressing drive method for passive matrix liquid crystal, including the steps of: simultaneously selecting seven row electrodes; calculating an exclusive OR between a 7-bit row selection vector representing a selection pattern of the seven row electrodes and 7-bit ON/OFF display data representing a display pattern of column electrodes, for each corresponding bit; adding the exclusive ORs for each bit; when one-third of the maximum voltage of the column electrodes is Vc, selecting a voltage level of the column electrodes from four voltage levels: −3Vc, −Vc, +Vc and +3Vc, in accordance with a result of the addition.

Here, it is preferable that an orthogonal function composed of seven rows and eight columns is used as the selection pattern of the row electrodes.

Further, it is preferable that the voltage level of the column electrodes is selected from the four voltage levels in accordance with high-order two bits among a 3-bit binary number representing the result of the addition.

Further, it is preferable that when the result of the addition is 0 or 1, the voltage level of the column electrodes is set to −3Vc, when the result of the addition is 2 or 3, the voltage level of the column electrodes is set to −Vc, when the result of the addition is 4 or 5, the voltage level of the column electrodes is set to +Vc, and when the result of the addition is 6 or 7, the voltage level of the column electrodes is set to +3Vc.

Further, in order to attain the above-mentioned first object, according to a second mode of the first aspect of the present invention, there is provided a multiline addressing drive method for passive matrix liquid crystal, including the steps of: simultaneously selecting eleven row electrodes; calculating an exclusive OR between a 11-bit row selection vector representing a selection pattern of the eleven row electrodes and 11-bit ON/OFF display data representing a display pattern of column electrodes, for each corresponding bit; adding the exclusive ORs for each bit; when one-fifth of the maximum voltage of the column electrodes is Vc, selecting a voltage level of the column electrodes from six voltage levels: −5Vc, −3Vc, −Vc, +Vc, +3Vc and +5Vc, in accordance with a result of the addition.

Here, it is preferable that an orthogonal function composed of eleven rows and twelve columns is used as the selection pattern of the row electrodes.

Further, it is preferable that the voltage level of the column electrodes is selected from the six voltage levels in accordance with high-order three bits among a 4-bit binary number representing the result of the addition.

Further, it is preferable that when the result of the addition is 0 or 1, the voltage level of the column electrodes is set to −5Vc, when the result of the addition is 2 or 3, the voltage level of the column electrodes is set to −3Vc, when the result of the addition is 4 or 5, the voltage level of the column electrodes is set to −Vc, when the result of the addition is 6 or 7, the voltage level of the column electrodes is set to +Vc, when the result of the addition is 8 or 9, the voltage level of the column electrodes is set to +3Vc, and when the result of the addition is 10 or 11, the voltage level of the column electrodes is set to +5Vc.

Further, in order to attain the above-mentioned first object, according to a third mode of the first aspect of the present invention, there is provided a multiline addressing drive method for passive matrix liquid crystal, including the steps of: simultaneously selecting Y row electrodes, where Y is an odd number of 7 and above; calculating an exclusive OR between a Y-bit row selection vector representing a selection pattern of the Y row electrodes and Y-bit ON/OFF display data representing a display pattern of column electrodes, for each corresponding bit; adding the exclusive ORs for each bit; when X=(Y+1)/2, a 1/(X−1) voltage of the maximum voltage of the column electrodes is Vc, and i=0, 1, 2, . . . , (X−1), selecting a voltage level of the column electrodes from X voltage levels satisfying:

$$[2\times i-(X-1)]\times Vc$$

in accordance with a result of the addition.

Here, it is preferable that an orthogonal function composed of Y rows and Z columns is used as the selection pattern of the row electrodes, where Z is an integer larger than Y.

Here, it is preferable that the voltage level of the column electrodes is selected from the X voltage levels by high-order (S−1) bits of an S-bit binary number representing the result of the addition.

In order to attain the above-mentioned first object, according to a fourth mode of the first aspect of the present invention, there is provided a multiline addressing driving apparatus for passive matrix liquid crystal for driving a liquid crystal display by the multiline addressing drive method for passive matrix liquid crystal, in which a column electrode driver and a row electrode driver are mounted on one chip.

In order to attain the above-mentioned second object, according to a first mode of a second aspect of the present invention, there is provided a method of driving passive matrix liquid crystal composed of a plurality of row electrodes and column electrodes, including the steps of: expressing an upper bit of gradation data corresponding to display data by a pulse width modulation gradation system while expressing a lower bit of the gradation data corresponding to the display data by a frame rate control gradation system; and allocating the representation by the frame rate control gradation system to minimum divided time periods in the pulse width modulation gradation system to add the frame rate control gradation system to the pulse width modulation gradation system.

Here, it is preferable that a selection time period for selecting the row electrodes is set to an upper bit of data of a larger number of gradations than the maximum gradations to be displayed, thereby mapping each gradation.

Further, it is preferable that a lower bit of gradation data corresponding to the display data is set to 3 bits, and a selection time period for selecting the row electrodes is set to a multiple of 8, thereby mapping each gradation.

Further, it is preferable that the passive matrix liquid crystal is driven by a multiline addressing drive system for simultaneously selecting a plurality of row electrodes from the row electrodes for driving.

Further, it is preferable that the multiline addressing drive system performs an exclusive OR between ON/OFF display data based on the gradation data of simultaneously selected rows and a row electrode selection pattern for each of the minimum divided time periods and adds the results.

Further, it is preferable that positions of ON based on the gradation data are distributed within a selection time period for selecting the row electrodes, in the pulse width modulation gradation system.

Further, it is preferable that the positions of ON based on the gradation data are distributed in two, within the selection time period for selecting the row electrodes.

Further, it is preferable that a frame rate control fixed area for stopping frame rate control is arbitrarily designated in the frame rate control gradation system.

Further, it is preferable that a frame rate control interval is fixed to the uppermost bit among lower bits of the gradation data within the frame rate control fixed area.

In order to attain the above-mentioned second object, according to a second mode of the second aspect of the present invention, there is provided a liquid crystal driving apparatus for driving super twisted nematic liquid crystal by the method of driving passive liquid crystal according to the first mode of the second aspect of the present invention.

In order to attain the above-mentioned third object, according to a first mode of a third aspect of the present invention, there is provided a multiline addressing drive method for passive matrix liquid crystal, including the steps of: allocating a plurality of orthogonal functions of an orthogonal function set obtained by rotating row vectors of an orthogonal function used in a selection pattern of simultaneously selected row electrodes to each of a plurality of divided selection time periods obtained by dividing a selection time period of one row electrode of the simultaneously selected row electrodes; and allowing column vectors of the allocated orthogonal function to loop back in time series in the respective divided selection time periods.

Here, it is preferable that the number of the divided selection time periods is set smaller than the number of the orthogonal functions in the orthogonal function set obtained by rotating the row vectors of the orthogonal function.

Further, according to the multiline addressing drive method for passive matrix liquid crystal, it is preferable that: an upper bit of gradation data corresponding to display data is expressed by a pulse width modulation gradation system whereas a low-bit of the gradation data corresponding to the display data is expressed by a frame rate control gradation system, and liquid crystal is driven such that the representation in the frame rate control gradation system is allocated to minimum divided time periods in the pulse width modulation gradation system to add the frame rate control gradation system to the pulse width modulation gradation system; and that the set of the orthogonal functions are allocated to every an integer number larger than an integer number of a quotient obtained by dividing the number of sequences serving as a minimum unit obtained by dividing a selection time period of one row electrode by the number of simultaneously selected rows in the multiline addressing drive system.

In order to attain the above-mentioned third object, according to a second mode of the third aspect of the present invention, there is provided a multiline addressing drive method for passive matrix liquid crystal, including the steps of: loading an initial value of a column vector of an orthogonal function used as a selection pattern of simultaneously selected row electrodes; and rotating a bit of the loaded initial value for each of a plurality of divided selection time periods obtained by dividing a selection time period of one row electrode of the simultaneously selected row electrodes.

Here, it is preferable that the initial value of the column vector of the orthogonal function is updated for each block serving as a unit of the simultaneously selected row electrodes.

Further, it is preferable that the initial value of the column vector of the orthogonal function is updated for each field serving as a unit for scanning once all rows from the top to the bottom on a liquid crystal panel.

In order to attain the above-mentioned third object, according to a third mode of the third aspect of the present invention, there is provided a multiline addressing driving apparatus (liquid crystal driver) for passive matrix liquid crystal, for driving passive matrix liquid crystal by the multiline addressing drive method for passive matrix liquid crystal according to the first or second mode of the third aspect of the present invention.

In order to attain the above-mentioned third object, according to a fourth mode of the third aspect of the present invention, there is provided a liquid crystal display panel (liquid crystal panel) driven by the multiline addressing drive method for passive matrix liquid crystal according to the first or second mode of the third aspect of the present invention.

BRIEF DESCRIPTION OF THE DRAWINGS

FIG. 2 is an explanatory view for showing an example of a matrix representing an orthogonal function composed of 7 rows and 8 columns, showing a row electrode selection pattern used in the embodiment shown in FIG. 1.

FIGS. 3A, 3B, 3C, 3D and 3E are explanatory views respectively showing a row electrode selection pattern, a display pattern, the result of summation of products, a column electrode voltage pattern and values corresponding to the effective voltage in the embodiment shown in FIG. 1.

FIG. 6 is an explanatory view for showing an example of a matrix representing an orthogonal function composed of 11 rows and 12 columns, showing a row electrode selection pattern used in the embodiment shown in FIG. 5.

FIGS. 7A, 7B, 7C, 7D and 7E are explanatory views respectively showing a row electrode selection pattern, a display pattern, the result of summation of products, a column electrode voltage pattern and values corresponding to the effective voltage in the embodiment shown in FIG. 5.

FIGS. 9A, 9B, 9C, 9D and 9E are explanatory views respectively showing a row electrode selection pattern, a display pattern, the result of summation of products, a column electrode voltage pattern and values corresponding to the effective voltage in the case shown in FIG. 8 where the number of row electrodes is 33.

FIG. 20 is an explanatory view showing a block update mode which is one update mode of column vectors in the embodiment shown in FIG. 19.

FIG. 21 is an explanatory view showing a field update mode which is another update mode of column vectors in the embodiment shown in FIG. 19.

FIG. 22 is an explanatory view showing an example of an orthogonal function of a Walsh function composed of 7 rows and 8 columns in the embodiment shown in FIG. 19.

FIG. 23 is an explanatory view showing an example of a set of orthogonal functions obtained by rotating the row vectors of the orthogonal function shown in FIG. 22.

FIG. 24 is an explanatory view showing the rotation of the row vectors of the orthogonal function in divided selection time periods in the set of the orthogonal functions shown in FIG. 23.

BEST MODE FOR CARRYING OUT THE INVENTION

A method and an apparatus for driving passive matrix liquid crystal according to the present invention will be described below in detail based on preferred embodiments illustrated in the accompanying drawings.

Although one scanning for all rows on a liquid crystal panel is normally designated by the term "frame", such scanning is designated by the term "field" throughout this specification. Similarly, although the completion of display of one image by using a plurality of fields is sometimes designated by the term "frame", it is designated by the term "display cycle" for distinction.

First, with reference to FIGS. 1 to 9E, multiline addressing drive method and apparatus for passive matrix liquid crystal of a first mode of the present invention are described.

Figure 1:
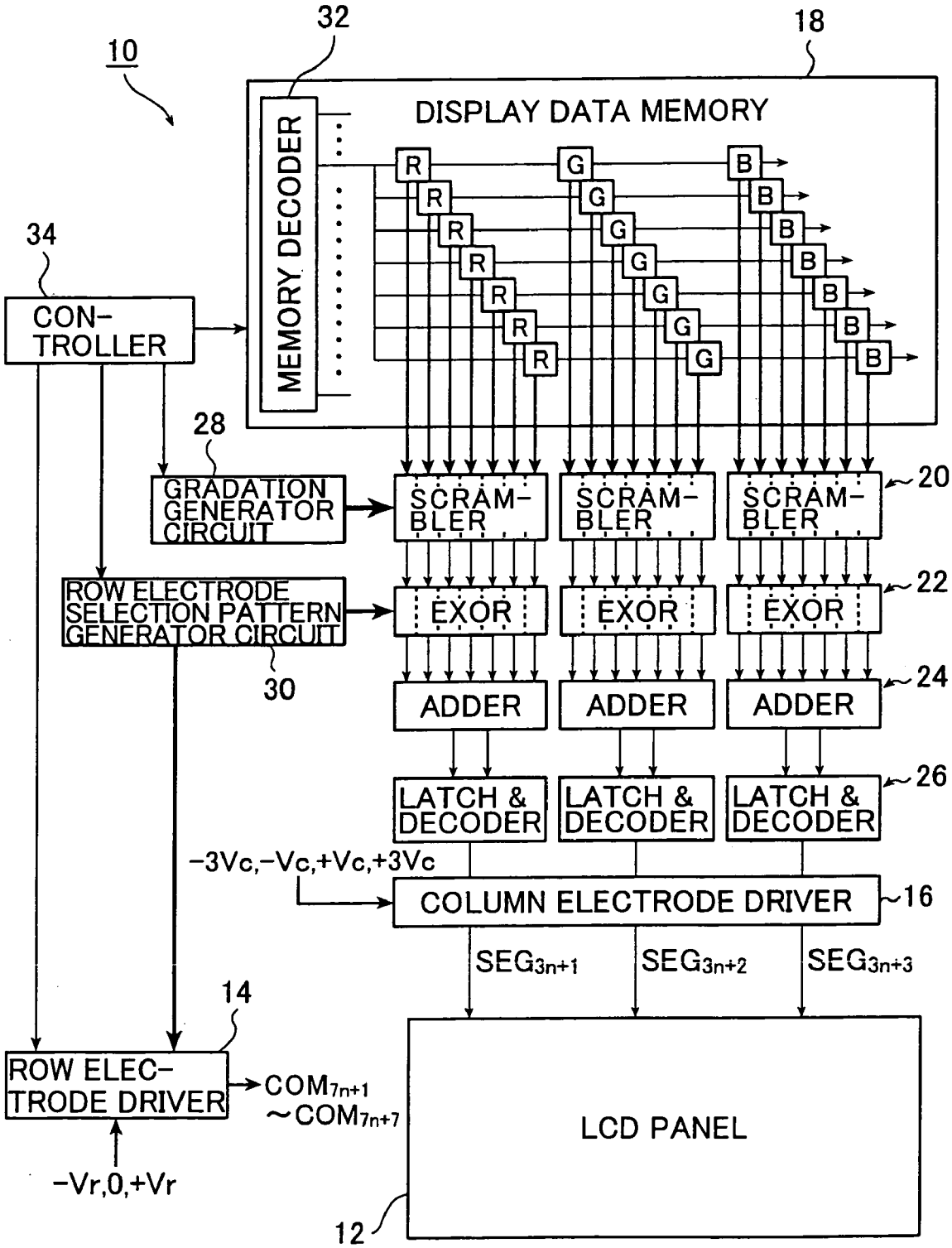
FIG. 1 is a block diagram showing a circuit configuration of an embodiment of an apparatus (LCD driver) for implementing a multiline addressing drive method for passive matrix liquid crystal according to a first mode of the present invention.

FIG. 1 is a block diagram showing a circuit configuration of an embodiment (first embodiment) of a liquid crystal driving apparatus (LCD driver) for implementing a multiline addressing drive method for passive matrix liquid crystal according to a first mode of the present invention. The LCD driver according to this embodiment selects 7 row electrodes at a time and sets four voltage levels for the column electrodes. In the present invention, this drive method is referred to as an FLA7 (Four-Level Addressing 7) drive system.

As shown in FIG. 1, an LCD driver 10 of this embodiment employs the MLA drive system for simultaneously selecting seven rows (COMMON) from row electrodes on an LCD panel 12 and driving the LCD panel at four voltage levels of the column electrodes. The LCD driver includes a row electrode driver 14, a column electrode driver 16 and a display data memory (for example, RAM) 18.

The LCD driver also includes, for each column (segment) of each color of RGB, a scrambler 20, an EXOR gate 22, an adder 24 and a latch and decoder (latch & decoder) 26. For gradation display, a gradation generator circuit 28 for transmitting gradation conversion data to the scramblers 20 and a row electrode selection pattern generator circuit 30 for transmitting a row electrode selection pattern to the EXOR gates 22 and the row electrode driver 14 are provided. Moreover, a memory decoder 32 is provided for the display data memory 18.

Furthermore, a controller 34 for controlling each of these components is installed.

Color data for seven rows on the LCD panel 12, which are simultaneously driven, are simultaneously output from the display data memory 18 to the scramblers 20. The scramblers 20 output ON/OFF display data corresponding to the gradation conversion data received from the gradation generator circuit 28, respectively. The results of exclusive ORs between the ON/OFF display data output from the scramblers 20 and the respectively corresponding row electrode selection patterns received from the row electrode selection pattern generator circuit 30 are obtained by the EXOR gate 22, which are in turn added by the adder 24.

The results of addition are input to the latch and decoders 26. Setting one-third of the maximum voltage of the column electrodes to Vc, a voltage level corresponding to the result of addition is selected by each of the latch and decoders 26 from four values, i.e., −3Vc, −Vc, +Vc and +3Vc, so as to be output to the column electrode driver 16. Then, the LCD panel 12 is driven by the row electrode driver 14 and the column electrode driver 16.

Hereinafter, the function of this embodiment will be described in detail.

In this embodiment, seven row electrodes are simultaneously selected. As a row electrode selection pattern to be generated in the row electrode selection pattern generator circuit 30, an orthogonal function composed of 7 rows and 8 columns is used. This orthogonal function is represented by, for example, an orthonormal matrix $M_1$ as shown in FIG. 2. More specifically, a product of the matrix $M_1^t$ and its transpose $M_1^t$ of the matrix itself becomes an integer multiple of a unit matrix I. In the case of the matrix $M_1$ shown in FIG. 2, $M_1M_1^t=8I$ (where I is a 7-th unit matrix). Such a matrix can be obtained by, for example, excluding one row from an Hadamard matrix (in this case, an 8-th Hadamard matrix).

FIGS. 3A, 3B, 3C, 3D and 3E respectively show a row electrode selection pattern, a display pattern, the result of summation of products, a column electrode voltage pattern and values corresponding to the effective voltage in this embodiment. Although the display pattern shown in FIG. 3B and the like are present in 2 raised to the seventh power=128 ways in total, a part thereof is herein omitted.

In FIG. 3A, 1 and −1 shown in the row electrode selection pattern are represented by +Vr and −Vr, respectively. An ON pixel and an OFF pixel in the ON/OFF display data are represented by 1 and −1, respectively.

The column electrode voltage pattern shown in FIG. 3D is determined as follow in terms of calculation.

More specifically, first, a row selection column vector consisting of 7 bits, constituting each column vector of the row electrode voltage selection pattern shown in FIG. 3A and 7-bit ON/OFF display data (vector) of the same column electrode constituting each row vector of the display pattern shown in FIG. 3B are multiplied for each corresponding bit. For example, the sum of products of a row selection column vector on the first column of the row electrode selection pattern in FIG. 3A, indicated with a cycle #1, $(-1, -1, -1, 1, 1, 1, -1)^t$, (where a superscript t indicates the transpose as in the case of a matrix) and ON/OFF display data (1, 1, 1, 1, 1, 1, 1) on the first row of the display pattern shown in FIG. 3B is calculated to be: $(-1)\times1+(-1)\times1+(-1)\times1+1\times1+1\times1+1\times1+(-1)\times1=-1$. This result corresponds to −1 on the first row and the first column, on the upper left of the result of the summation of products shown in FIG. 3C. The sum of products of a row selection column vector on the second column of the row electrode selection pattern indicated with a cycle #2 shown in FIG. 3A and the first row of the display pattern shown in FIG. 3B is obtained as −1, indicated on the first row and the second column of the result of summation of products shown in FIG. 3C. The other elements are similarly calculated to obtain the table showing the result of summation of products of FIG. 3C.

As shown in FIG. 3C, eight numerical values, i.e., ±7, ±5, ±3 and ±1 appear as the result of summation of products. Conventionally, these eight (7+1=8) voltage levels are required to select seven rows. On the other hand, in the present invention, by replacing −7 and −5 with +3Vc, −3 and −1 with +Vc, +1 and +3 with −Vc, and +5 and +7 with −3Vc, the number of voltage levels is reduced to four, −3Vc, −Vc, +Vc and −3Vc, so that the column electrodes have four voltage levels.

In FIG. 3D, the result of summation of products is transformed by the following Table 1 to produce a column electrode voltage pattern.

TABLE 1

| Result of summation of products | Column electrode pattern |
|---|---|
| −7, −5 | 3 |
| −3, −1 | 1 |
| 1, 3 | −1 |
| 5, 7 | −3 |

In this manner, the column electrode voltage pattern as shown in FIG. 3D is determined.

The value corresponding to the effective voltage shown in FIG. 3E is obtained by adding the column electrode pattern for each cycle in accordance with the value (−1 and 1) of the row electrode selection pattern shown in FIG. 3A. More specifically, the value corresponding to the effective voltage is obtained by adding the column electrode voltage pattern without any further operation on it if the row electrode selection pattern is −1 and by adding the column electrode voltage pattern after the column electrode voltage pattern is subjected to polarity inversion if the row electrode selection pattern is 1. Ultimately, the sum of products of corresponding elements between each row of the row electrode selection pattern of FIG. 3A and each row of the column electrode selection pattern of FIG. 3D, whose sign is in turn changed, is a value corresponding to the effective voltage. For example, the sum of products of a first row of the row electrode selection pattern shown in FIG. 3A (−1, −1, −1, −1, −1, 1, −1, −1) and a first row of the column electrode voltage pattern shown in FIG. 3D (1, 1, 1, 1, 1, 3, 1, 1) is obtained as: $(-1)\times1+(-1)\times1+(-1)\times1+(-1)\times1+(-1)\times1+1\times3+(-1)\times1+(-1)\times1=-4$. When the sign of the result is changed, +4 is obtained. This value 4 is a value corresponding to the effective voltage on the first row and the first column (R1) of FIG. 3E. Similarly, the sum of products of the second row of the row electrode selection pattern of FIG. 3A and the first row of the column electrode voltage pattern of FIG. 3D followed by changing its sign is obtained to be 4, a value corresponding to the effective voltage, on the first row and the second column (R2) in FIG. 3E. A similar calculation is performed for the other elements, thereby obtaining a table of the values corresponding to the effective voltage shown in FIG. 3E.

In comparison of the thus obtained values corresponding to the effective voltage of FIG. 3E with the display pattern of FIG. 3B, all ON pixels have the same effective voltage of 4, whereas all OFF pixels have the same effective voltage of −4. This shows that the voltage averaging has been established.

Although the method of obtaining the column electrode voltage pattern of FIG. 3D by means of calculation has been described above, the case where this method is realized in the logic circuit shown in FIG. 1 will be described below.

It is determined that values 1 and 0 in the row electrode selection pattern are +Vr and −Vr, respectively, while the ON pixel and OFF pixel in the ON/OFF display data are 1 and 0, respectively.

In the circuit block of FIG. 1, for example, in the case of 4K colors, RGB are respectively expressed by 4 bits, so that each of RGB has the fourth power of 2 number of gradations. In total, $2^4\times2^4\times2^4=4096$ colors are expressed. In the display data memory 18, 12-bit data, each data consisting of 4 bits, are stored for each pixel. When the memory decoder 32 selects seven rows from them, the respective R, G and B data for seven rows are collected so as to be respectively sent to the scramblers 20. At this point, the gradation generator circuit 28 sends the gradation conversion data for setting ON or OFF of a certain gradation within the display cycle to the scramblers 20. As a result, ON/OFF is determined for each row and each color, so that ON/OFF display data for those seven rows are output from the scramblers 20.

Although FIG. 1 shows an example where the memory decoder 32 selects seven rows, R, G and B data for seven rows may be output in time division.

The exclusive ORs are obtained in the EXOR circuit 22 between the outputs from the scramblers 20 and the outputs from the row electrode selection pattern generator circuit 30. The results of the exclusive ORs are added by the adder 24. As described above, since the ON/OFF display data is 1 or 0, the addition of 7 bits obtained by the exclusive OR produces data of 0 to 7, which can be represented by a 3-bit binary number. Among these 3 bits, one bit of the lowest order is omitted while two bits of the higher order are latched and decoded so that the corresponding voltage is selected from −3Vc, −Vc, +Vc and +3Vc. More specifically, the four voltage levels are determined in such a way that, if the added value is 0 or 1, −3Vr is selected, if 2 or 3, −Vr, if 4 or 5, +Vr, and if 6 or 7, +3Vr is selected. This voltage is used as the voltage level for the column electrodes so as to be applied to the column electrodes of the LCD panel 12 by the column electrode driver 16.

In the row electrode driver 14, the corresponding voltage is selected from −Vr, 0 and +Vr in accordance with the column vector from the row electrode selection pattern generator circuit 30. More specifically, if that row electrode is selected, +Vr or −Vr is applied to the LCD panel 12 by the row electrode driver 14, if not selected, 0 is applied thereto. The controller 34 controls each circuit at appropriate timing in accordance with the signal and the setting from the exterior. The LCD panel 12 is driven by the row electrode driver 14 and the column electrode driver 16 so as to display 4096-gradation colors on the LCD panel 12. Then, with respect to the selected seven rows, the display is similarly performed for eight cycles shown in the row electrode selection pattern of FIG. 3A to complete a display cycle.

Figure 4:
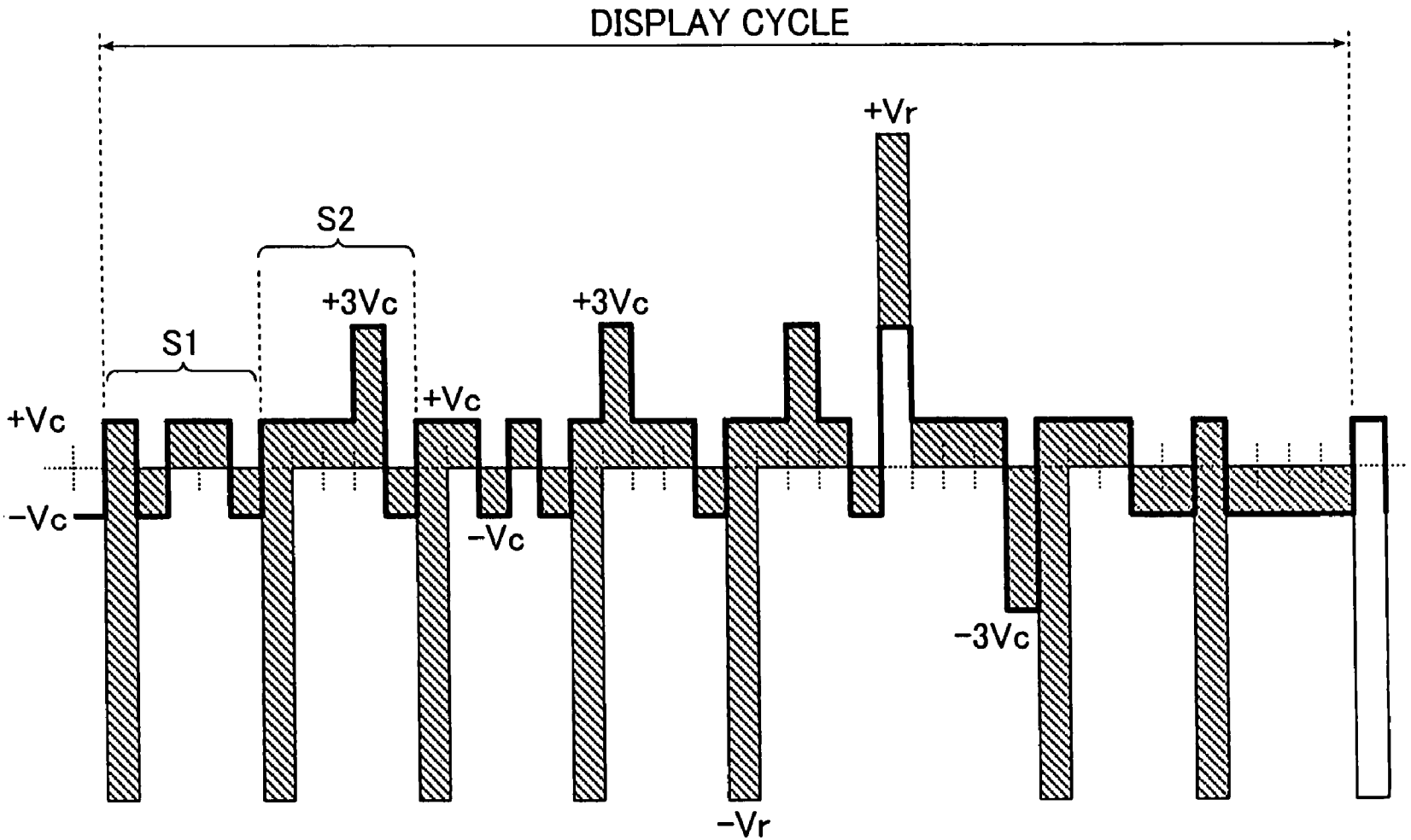
FIG. 4 is an explanatory view showing an example of a display cycle in the case where the number of row electrodes is 35, in the embodiment shown in FIG. 1.

FIG. 4 shows an example of a display cycle where the number of row electrodes is 35.

In FIG. 4, eight cycles of a row 1 of the row electrode selection pattern in FIG. 3A, #1 to #8 (−1, −1, −1, −1, −1, 1, −1, −1) are indicated with −Vr and +Vr, where −Vr corresponds to −1 and +Vr corresponds to 1. The voltage levels of the column electrodes, +3Vc, +Vc, −Vc, or −3Vc, are selected in the following manner. In the example of FIG. 4, the number of row electrodes is 35, and the selection is made for seven rows at a time. Therefore, the row electrodes is divided into 5 (=35÷7) blocks, so that, five rows, that is, the first four rows D1 and the last row D2 of the column electrode voltage pattern of FIG. 3D are used. Therefore, during a first cycle S1 of FIG. 4, the elements of D1 and D2 on the first column, 1, −1, 1, 1 and −1, are used so as to apply the voltages +Vc, −Vc, +Vc, +Vc and −Vc to the column electrodes. During a next cycle S2, the elements of D1 and D2 on the second column, 1, 1, 1, 3 and −1, are used so as to apply the voltages +Vc, +Vc, +Vc, +3Vc and −Vc to the column electrodes.

In this manner, the similar operation is performed for eight cycles to complete the display cycle.

The addition of differences between voltages of the column electrodes (segment voltages) and voltages of the row electrodes (common voltages) produces a value corresponding to the effective voltage. More specifically, the sum of areas shaded with slant lines in FIG. 4 corresponds to such a value.

Hereinafter, a specific method of calculating the effective voltage value will be described.

As shown in the column electrode voltage pattern of FIG. 3D, one 3 or −3 and seven 1 or −1 appear in each row in the column electrode voltage pattern of eight cycles. Therefore, the following four cases can be considered when a value corresponding to the effective voltage is 4 or −4 as the values corresponding to the effective voltage indicated in FIG. 3E.

$$4=-3+1+1+1+1+1+1+1 \quad (1)$$

$$4=3+1+1+1+1-1-1-1 \quad (2)$$

$$-4=3-1-1-1-1-1-1-1 \quad (3)$$

$$-4=-3-1-1-1-1+1+1+1 \quad (4)$$

In the above case (1), a voltage (Vr−3Vc) is applied once to the ON pixels while a voltage (Vr+Vc) is applied seven times thereto. In the case (2), a voltage (Vr+3Vc) is applied once to the ON pixels while a voltage (Vr+Vc) and a voltage (Vr−Vc) are applied four times and three times thereto. In a similar manner, in the case (3), a voltage (Vr+3Vc) is applied once to the OFF pixels while a voltage (Vr−Vc) is applied seven times thereto. In the case (4), a voltage (Vr−3Vc) is applied once to the OFF pixels while a voltage (Vr−Vc) and a voltage (Vr+Vc) are applied four times and three times thereto, respectively.

The cases where the row electrodes are selected are described above. When the row electrodes are not selected, the voltages are applied for an integer multiple of 8 times, 8 times being the total number of applications, that is, a voltage +3Vc or −3Vc and a voltage +Vc or −Vc are applied once and seven times, respectively.

The case of 35 row electrodes shown in FIG. 4 corresponds to the above case (1). The effective voltage value Von of the ON pixels is calculated by the following Formula (1):

$$Von=\sqrt{\{P/(5\times 8)\}} \quad (1)$$

where $P=(Vr-3Vc)^2+(Vr+Vc)^2\times 7+(3Vc)^2\times 4+Vc^2\times 4\times 7$.

Considering the case where the number of row electrodes is N, the number of blocks is generally N/7. As voltage to be applied to the ON pixels in the above case (1), a voltage (Vr−3Vc) is applied once, a voltage (Vr+Vc) is applied seven times, a voltage +3Vc or −3Vc is applied (N/7)−1 times, and a voltage +Vc or −Vc is applied ((N/7)−1)×7 times. In the case where N/7 is not an integer, the figures below the decimal point may be rounded up. In such a case, an effective value voltage Von of the ON pixels is calculated by the following Formula (2):

$$Von=\sqrt{\{Q/((N/7)\times 8)\}} \quad (2)$$

where $Q=(Vr-3Vc)^2+(Vr+Vc)^2\times 7+(3Vc)^2\times((N/7)-1)+Vc^2\times((N/7)-1)\times 7$.

This formula is simplified as the following Formula (3):

$$Von=(1/\sqrt{N})\times Vr\times\sqrt{\{2\times N\times A^2+7\times A+7\}} \quad (3)$$

where A=Vc/Vr.

In the case where the number of row electrodes is N, as voltages to be applied to the ON pixels in the above case (2), a voltage (Vr+3Vc) is applied once, a voltage (Vr+Vc) is applied four times, a voltage (Vr−Vc) is applied three times, a voltage +3Vc or −3Vc is applied (N/7)−1 times, and a voltage +Vc or −Vc is applied ((N/7)−1)×7 times. Thus, the effective voltage value Von of the ON pixels is obtained in the same manner as described above as the following Formula (4):

$$Von=\sqrt{\{R/((N/7)\times 8)\}} \quad (4)$$

where $R=(Vr+3Vc)^2+(Vr+Vc)^2\times 4+(Vr-Vc)^2\times 3+(3Vc)^2\times((N/7)-((N/7)-1)\times 7$.

This formula is simplified as the following Formula (5):

$$Von=(1/\sqrt{N})\times Vr\times\sqrt{\{2\times N\times A^2+7\times A+7\}} \quad (5)$$

where A=Vc/Vr.

Therefore, the effective voltage values of the ON pixels are all the same eventually.

Similarly, in the case where the number of row electrodes is N (N/7 blocks), as voltages to be applied to the OFF pixels in the above case (3), a voltage (Vr+3Vc) is applied once, a voltage (Vr−Vc) is applied seven times, a voltage +3Vc or −3Vc is applied (N/7)−1 times, and a voltage +Vc or −Vc is applied ((N/7)−1)×7 times. Thus, the effective voltage value Voff of the OFF pixels in this case is obtained in the same manner as described above as the following Formula (6):

$$Voff=\sqrt{\{S/((N/7)\times 8)\}} \quad (6)$$

where $S=(Vr+3Vc)^2+(Vr-Vc)^2\times7+(3Vc)^2\times((N/7)-1)+Vc^2\times((N/7)-1)\times7$.

This formula is simplified as the following Formula (7):

$$Voff=(1/\sqrt{N})\times Vr\times\sqrt{\{2\times N\times A^2-7\times A+7\}} \quad (7)$$

where A=Vc/Vr.

Similarly, an effective voltage value Voff of the OFF pixels is calculated for the above case (4) to be the same as the effective voltage value Voff in the case (3). Ultimately, the effective voltage values of the OFF pixels are all obtained to be the same value.

Thus, since all effective voltage values of the ON pixels are identical while all effective voltage values of the OFF pixels are identical, the voltage averaging is established.

In design of a drive circuit, a ratio (bias) of the column electrode voltage and the row electrode voltage is required. An ideal bias will be described.

The effective voltages Von and Voff of the drive circuit are required to range from a voltage at which the liquid crystal is turned ON to a voltage at which the liquid crystal is turned OFF.

If a distance between the effective voltage Von of the ON pixels and the effective voltage Voff of the OFF pixels is small, the liquid crystal is not brought into a complete ON or OFF state. As a result, the contrast is lowered. It is preferred that a ratio Von/Voff of the effective voltages Von to Voff of the drive circuit is set as large as possible. Therefore, in the formula:

$$Von/Voff=\sqrt{\{(2\times N\times A^2+7\times A+7)/(2\times N\times A^2-7\times A+7)\}},$$

the radicand below the radical sign $\sqrt{}$ substituted by Y(A) so as to obtain A=Vc/Vr which maximizes Y(A). The formula:

$$Y(A)=\{(2\times N\times A^2+7\times A+7)/(2\times N\times A^2-7\times A+7)\}$$

is differntiated with respect to A so as to obtain a value of A which maximizes Y(A) within the range: A>0. Then, $A=Vc/Vr=\sqrt{\{7/(2\times N)\}}$ is obtained. The obtained value is an ideal bias. Then, an ON/OFF ratio is:

$$Von/Voff=\sqrt{\{(2\times\sqrt{(2\times N)}+\sqrt{7})/(2\times\sqrt{(2\times N)}-\sqrt{7})\}}.$$

In this embodiment, for example, in standard high-speed liquid crystal having a threshold voltage of 2.1 V, in the case where the number of row electrodes is 160, a bias A is assumed to be 1/7. Then, a selection voltage Vr is sufficiently as low as about 7.5 V. Therefore, even at +Vr, a voltage can be as low as: 7.5×2=15.0, that is, 15 V or lower.

On the other hand, Vr is 19 V (at ±Vr, 19×2=38 V) in a conventional APT drive system, Vr is about 9.5 V in an MLA drive system with the number of simultaneously selected lines L=4, and Vr is about 11 V in a BLA 3 drive system. In an IAPT drive system using a practical waveform, at ±Vr, a selection voltage can be lower than: 19×2=38 V, that is, about 21 V.

As described above, however, according to the FLA7 drive system of the present invention rather than the above conventional systems, a selection voltage can be 15 V or lower even at +Vr. Therefore, the FLA7 drive method of the present invention has more excellent effects.

Thus, the FLA7 drive system is an extremely effective system for realizing multicolor, high image quality, compatibility to motion pictures, lowered power consumption, low price, bilateral symmetry, three free edges, and mounting on a single chip, which are commercial requirements for, in particular, an LCD module for portable telephone.

More specifically, in the FLA7 drive system, it is determined that the number of simultaneously selected rows is seven and the column electrode voltage has four values. The maximum used voltage is as low as about 15 V even in high-speed liquid crystal having 168 rows, which offers high response time. Therefore, a segment (column electrode) driver and a common (row electrode) driver can be mounted on a single chip in a fine-process for mounting a relatively large memory for multicolor display data. Moreover, since the frequency of occurrence of frame response phenomenon is small, high-contrast liquid crystal display can be realized.

Furthermore, since the size of a column electrode drive circuit in the FLA7 drive system is smaller than that in the MLA drive system with eight selected rows, the size of a chip is also small. Thus, since a drive amplitude of the row electrode selection voltage is small (row electrode voltage Vr=7.5 Vmax) to allow the reduction of an operation frequency, the power consumption is correspondingly small.

Next, a second embodiment of the first mode of the present invention will be described.

Figure 5:
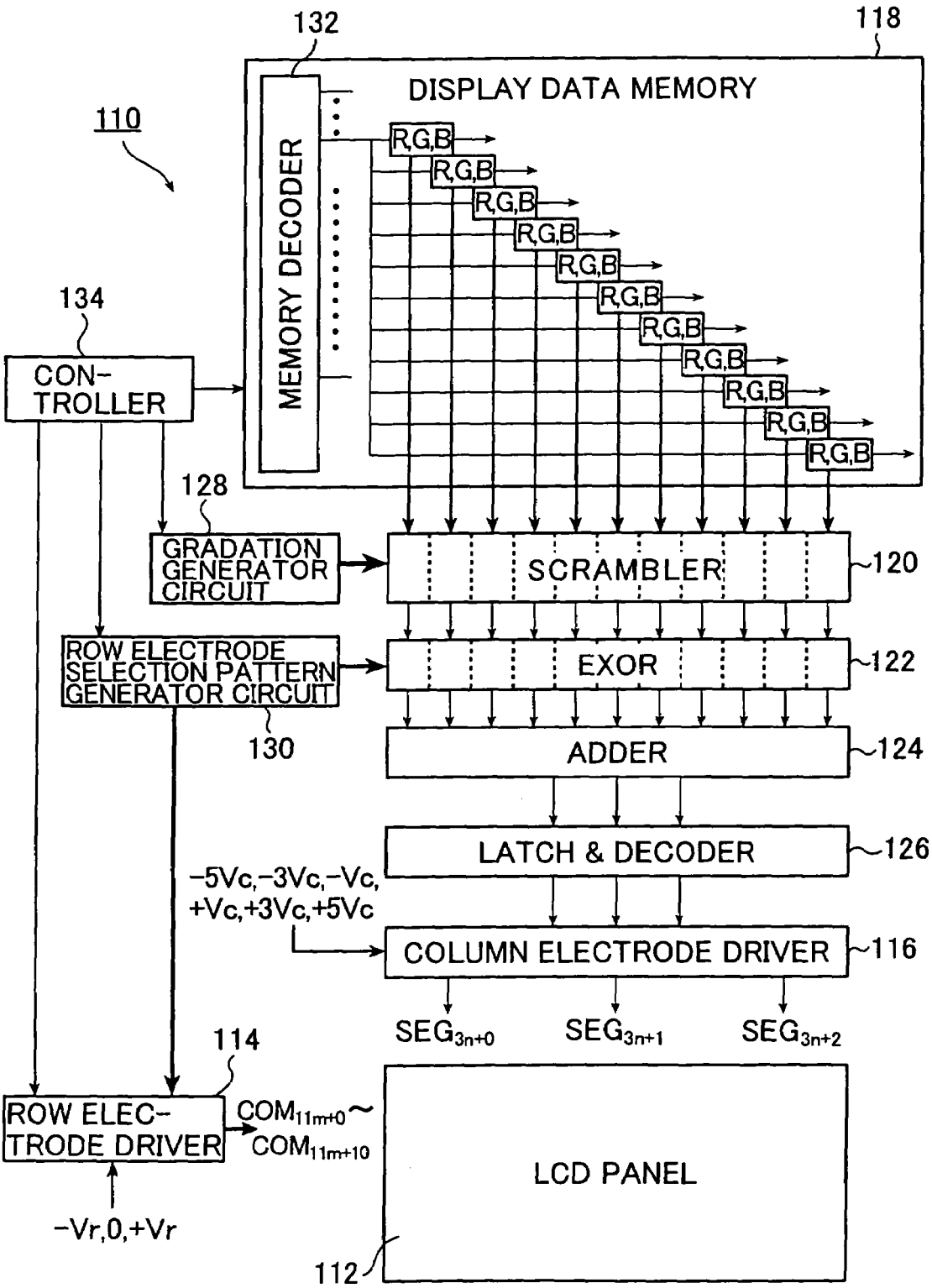
FIG. 5 is a block diagram showing a circuit configuration of another embodiment of an apparatus (LCD driver) for implementing a multiline addressing drive method for passive matrix liquid crystal according to the present invention.

FIG. 5 is a block diagram showing a circuit configuration of another embodiment (second embodiment) of a liquid crystal driving apparatus (LCD driver) for implementing a multiline addressing drive method for passive matrix liquid crystal according to the present invention. The LCD driver according to this second embodiment simultaneously selects eleven row electrodes and has six voltage levels of the column electrodes. In the present invention, this drive method is referred to as SLA11 (Six-Level Addressing 11). An LCD driver 110 shown in FIG. 5 basically has a structure similar to that of the LCD driver 10 shown in FIG. 1 except that the number of simultaneously selected row electrodes is 11 instead of 7, the number of voltage levels of the column electrodes is 6 instead of 4, and only one scrambler, EXOR, adder and latch and decoder are provided because RGB are respectively processed in time division instead of being processed for each color of RGB. Moreover, since the components of the LCD drivers are basically the same and have similar functions, the reference numerals have the same numerals in the lower two orders thereof.

As shown in FIG. 5, the LCD driver 110 according to this embodiment employs the MLA system for simultaneously selecting eleven rows (COMMON) of the LCD panel 112 so as to drive the column electrodes of the LCD panel at six voltage values. The LCD driver includes a row electrode driver 114, a column electrode driver 116 and a display data memory 118.

Moreover, the LCD driver further includes a scrambler 120, an EXOR gate 122, an adder 124 and a latch and decoder (latch & decoder) 126 so as to process signals of the respective colors of RGB in time series. For gradation display, a gradation generator circuit 128 for sending the gradation conversion data to the scrambler 120 and a row electrode selection pattern generator circuit 130 for sending the row electrode selection pattern to the EXOR gate 122 and the row electrode driver 114 are provided. Furthermore, a memory decoder 132 is provided for the display data memory 118.

In addition, a controller 134 for controlling each of these components is placed.

Color data for eleven rows of the LCD panel 112, which are simultaneously driven, are simultaneously output from the display data memory 118 to the scrambler 120. The scrambler 120 outputs ON/OFF display data corresponding to gradation conversion data received from the gradation generator circuit 128, respectively. Exclusive ORs between the ON/OFF display data output from the scrambler 120 and the corresponding row electrode selection patterns received from the row electrode selection pattern generator circuit 130 are obtained by the EXOR gate 122, which are in turn added by the adder 124.

The result of addition is input to the latch and decoder 126. Setting one-fifth of the maximum voltage of the column electrodes to Vc, the voltage level corresponding to the result of addition is selected from six values, −5Vc, −3Vc, −Vc, +Vc, +3Vc and +5Vc, by the latch and decoder 126 so as to be output to the column electrode driver 116. Then, the LCD panel 112 is driven by the row electrode driver 114 and the column electrode driver 116.

Since FIG. 5 shows an example where the respective colors of RGB are processed in time division, only one scrambler 120, EXOR gate 122, adder 124, and latch and decoder 126 are provided. However, as shown in FIG. 1, a set of these components may be provided for each column (segment SEG) of each color of RGB.

Hereinafter, the functions of this embodiment will be described in detail.

In this embodiment, eleven row electrodes are simultaneously selected. As a row electrode selection pattern to be generated in the row electrode selection pattern generator circuit 130, an orthogonal function composed of 11 rows and 12 columns is used. This orthogonal function is represented by, for example, an orthonormal matrix $M_2$ as shown in FIG. 6. More specifically, a product of the matrix $M_2$ and its transpose $M_2^t$ of the matrix itself becomes an integer multiple of the unit matrix I. In the case of the matrix $M_2$ shown in FIG. 6, $M_2M_2^t=12I$ (where I is an eleventh unit matrix). Such a matrix can be obtained by, for example, omitting one row from an Hadamard matrix (in this case, a twelfth Hadamard matrix).

FIGS. 7A, 7B, 7C, 7D and 7E respectively show a row electrode selection pattern, a display pattern, the result of summation of products, a column electrode voltage pattern and values corresponding to the effective voltage in this embodiment. Although the display pattern shown in FIG. 7B and the like is present in: the eleventh power of 2=2048 ways in total, a part thereof is omitted. In FIG. 7A, it is determined that 1 and −1 indicated in the row electrode selection pattern are respectively +Vr and −Vr. It is determined that an ON pixel and an OFF pixel in the ON/OFF display data are 1 and −1, respectively.

The orthogonal function represented by the matrix $M_2$ shown in FIG. 6 is obtained by inverting column vectors of the cycles #3 and #5 of the row electrode selection pattern of FIG. 7A, exchanging the column vectors of the cycles #3 and #11 with each other, and exchanging a row 4 and a row 7 with each other.

In FIG. 7D, a method of obtaining the column electrode voltage pattern is the same as in the case of FIG. 3D in the above-described first embodiment. More specifically, an 11-bit row selection column vector of the row electrode selection pattern of FIG. 7A and an 11-bit ON/OFF display data (row vector) of the same column electrode in the display pattern of FIG. 7B are multiplied for each corresponding bit, so that the results of multiplication are added. Twelve results of the summation of products, ±11, ±9, ±7, ±5, ±3 and +1, are obtained as shown in FIG. 7C. By substituting −11 and −9 by +5Vc, −7 and −5 by +3Vc, −3 and −1 by +Vc, +1 and +3 by −Vc, +5 and +7 by −3Vc, and +9 and +11 by −5Vc, the column electrode voltage pattern shown in FIG. 7D is determined.

Conventionally, the above-mentioned twelve voltage levels are required to select eleven rows. In the second embodiment of the present invention, the column electrodes are made to have six voltage levels, −5Vc, −3Vc, −Vc, +Vc, +3Vc and +5Vc in this manner.

The values corresponding to the effective voltage of FIG. 7E are obtained in a similar manner as in the case of FIG. 3E in the above-described first embodiment.

In comparison of the thus obtained values corresponding to the effective voltage of FIG. 7E with the display pattern of FIG. 7B, all ON pixels have the same effective voltage of 6, whereas all OFF pixels have the same effective voltage of −6. This shows that the voltage averaging has been established.

Although the method of obtaining the column electrode voltage pattern of FIG. 7D by means of calculation has been described above, the case where this method is realized in the logic circuit shown in FIG. 5 will be described below.

In the case where the above-described column electrode voltage pattern of FIG. 7D is realized in the logic circuit of FIG. 5, it is determined that 1 and 0 in the row electrode selection pattern are +Vr and −Vr, respectively, while the ON pixel and the OFF pixel in the ON/OFF display data are 1 and 0, respectively.

In the circuit block of FIG. 5, when the memory decoder 132 selects eleven rows, the respective R, G and B data for eleven rows are collected so as to be sent to the scramblers 120 in time series. At this point, the gradation generator circuit 128 sends the gradation conversion data for setting ON or OFF of a certain gradation in the display cycle to the scrambler 120. As a result, ON/OFF is determined for each row and each color, so that ON/OFF display data for those eleven rows are output from the scrambler 120.

Although the R, G and B data for eleven rows are output in time division in FIG. 5, a circuit may be constituted for each of R, G and B as in FIG. 1 of the above-described first embodiment.

The exclusive ORs are obtained in the EXOR circuit 122 between the outputs from the scrambler 120 and the outputs from the row electrode selection pattern generator circuit 130. The results of the exclusive ORs are added by the adder 24. As described above, since the ON/OFF display data is 1 or 0, the addition of 11 bits obtained by the exclusive ORs produces data of 0 to 11, which can be represented by a 4-bit binary number. Among these 4 bits, one bit of the lowest order is omitted while three bits of the higher order are latched and decoded so that the corresponding voltage is selected from −5Vc, −3Vc, −Vc, +Vc, +3Vc and +5Vc. More specifically, the voltage level is made to have six values in such a way that, if the added value is 0 or 1, −5Vc is selected, if 2 or 3, −3Vc, if 4 or 5, −Vc, if 6 or 7, +Vc, if 8 or 9, +3Vc, and if 10 or 11, +5Vc. This voltage is used as the voltage level for the column electrodes so as to be applied to the column electrodes of the LCD panel 112 by the column electrode driver 116.

In the row electrode driver 114, the corresponding voltage is selected from −Vr, 0 and +Vr in accordance with the column vector from the row electrode selection pattern generator circuit 130. More specifically, if that row electrode is selected, +Vr or −Vr is applied to the LCD panel 112 by the row electrode driver 114, if not selected, 0 is applied thereto.

The controller 134 controls each of the circuits at appropriate timing in accordance with the signal and the setting from the exterior. The LCD panel 112 is driven by the row electrode driver 114 and the column electrode driver 116. Then, with respect to the selected eleven rows, the display is similarly performed for twelve cycles shown in the row electrode selection pattern of FIG. 7A to complete a display cycle.

Figure 8:
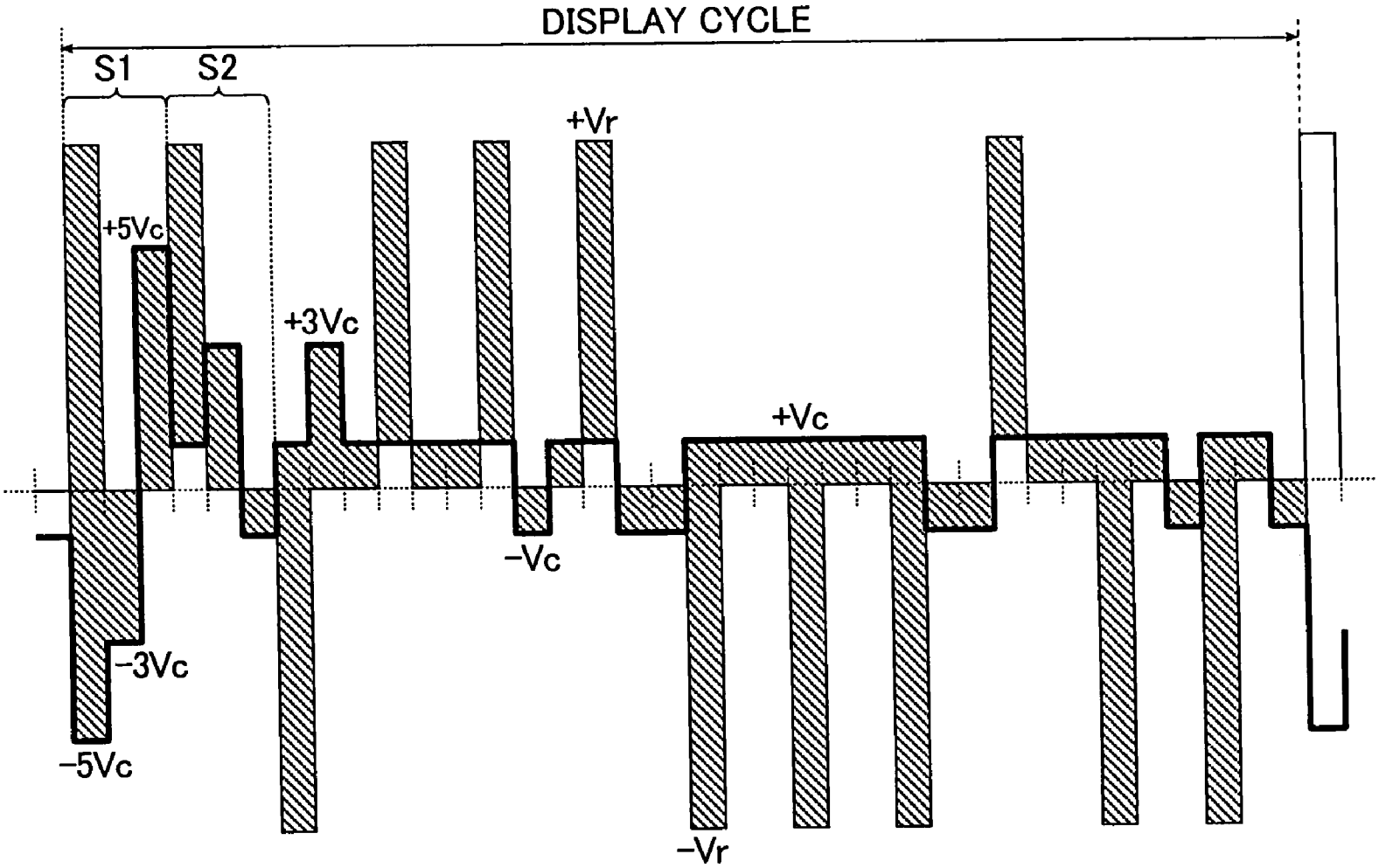
FIG. 8 is an explanatory view showing an example of a display cycle in the case where the number of row electrodes is 33, in the embodiment shown in FIG. 5.

FIG. 8 shows an example of a display cycle where the number of row electrodes is 33 (11 rows×3 blocks). In FIG. 8, eight cycles of a row 1 of the row electrode selection pattern in FIG. 7A, #1 to #12 (1, 1, −1, 1, 1, 1, −1, −1, −1, 1, −1, −1) are indicated by −Vr and +Vr, where −Vr corresponds to −1 and +Vr corresponds to 1. In the example of FIG. 8, the number of row electrodes is 33. Since the selection is made for eleven rows at a time, the row electrodes is divided into: 33÷11=3 blocks.

As shown in FIGS. 9A to 9E, as the voltage levels of the column electrodes, three rows indicated with * in FIGS. 7A to 7E, i.e., the first and seventh rows from the uppermost row and the ninth row from the lowermost row, are used to constitute the above-described three blocks. More specifically, during a first cycle S1 of FIG. 8, −5, −3 and 5 on the first column of the column electrode voltage pattern in FIG. 9D are used so as to apply the voltages −5Vc, −3Vc, and +5Vc to the column electrodes. During a next cycle S2, 1, 3 and −1 on the second column of the column electrode voltage pattern in FIG. 9D are used so as to apply the voltages +Vc, +3Vc and −Vc to the column electrodes.

In this manner, the similar operation is performed for twelve cycles to complete the display cycle.

The addition of differences between voltages of the column electrodes (segment voltages) and voltages of the row electrodes (common voltages) produces values corresponding to the effective voltage. More specifically, the sum of areas shaded with slant lines in FIG. 8 corresponds to such a value.

Hereinafter, a specific method of calculating the effective voltage value in the second embodiment will be described.

As shown in the column electrode voltage patterns of FIG. 7D, there are two types of the row electrode voltage pattern in twelve cycles. More specifically, in one case, one 5 or −5 and eleven 1 or −1 appear, and in the other case, three 3 or −3 and nine 1 or −1 appear.

Among them, it is in the following ten cases that a value corresponding to the effective voltage becomes 6 or −6.

$$6=-5+1+1+1+1+1+1+1+1+1+1+1 \quad (1)$$

$$6=-3-3+3+1+1+1+1+1+1+1+1+1 \quad (2)$$

$$6=-3+3+3+1+1+1+1+1+1+1-1-1-1 \quad (3)$$

$$6=3+3+3+1+1+1-1-1-1-1-1-1 \quad (4)$$

$$6=5+1+1+1+1+1+1-1-1-1-1-1 \quad (5)$$

$$-6=5-1-1-1-1-1-1-1-1-1-1-1 \quad (6)$$

$$-6=3+3-3-1-1-1-1-1-1-1-1-1 \quad (7)$$

$$-6=3-3-3-1-1-1-1-1-\mathbf{1+1+1+1} \quad (8)$$

$$-6=-3-3-3-1-1-1+1+1+1+1+1+1 \quad (9)$$

$$-6=-5-1-1-1-1-1-1+1+1+1+1+1 \quad (10)$$

In the above case (1), a voltage (Vr−5Vc) is applied once to the ON pixels while a voltage (Vr+Vc) is applied eleven times thereto. In the case (2), a voltage (Vr−3Vc) is applied twice to the ON pixels while a voltage (Vr+3Vc) and a voltage (Vr+Vc) are applied once and nine times thereto, respectively. In a similar manner, as voltage to be applied to the ON pixels in the case (3), a voltage (Vr−3Vc) is applied once, a voltage (Vr+3Vc) is applied twice, a voltage (Vr+Vc) is applied six times, and a voltage (Vr−Vc) is applied three times. In the case (4), a voltage (Vr+3Vc) is applied three times to the ON pixels while a voltage (Vr+Vc) and a voltage (Vr−Vc) are applied three times and six times thereto, respectively. In the case (5), a voltage (Vr+5Vc) is applied once to the ON pixels while a voltage (Vr+Vc) and a voltage (Vr−Vc) are applied six times and five times thereto, respectively.

In the case (6), a voltage (Vr+5Vc) is applied once to the OFF pixels while a voltage (Vr−Vc) is applied eleven times thereto. In the case (7), a voltage (Vr+3Vc) is applied twice to the OFF pixels while a voltage (Vr−3Vc) and a voltage (Vr−Vc) are applied once and nine times thereto, respectively. As voltage to be applied to the OFF pixels in the case (8), a voltage (Vr+3Vc) is applied once, a voltage (Vr−3Vc) is applied twice, a voltage (Vr−Vc) is applied six times, and a voltage (Vr+Vc) is applied three times. In the case (9), a voltage (Vr−3Vc) is applied three times to the OFF pixels while a voltage (Vr−Vc) and a voltage (Vr+Vc) are applied three times and six times thereto, respectively. In the case (10), a voltage (Vr−5Vc) is applied once to the OFF pixels while a voltage (Vr−Vc) and a voltage (Vr+Vc) are applied six times and five times thereto, respectively.

The cases where the row electrodes are selected are described above. As voltages to be applied when the row electrodes are not selected, there are also two types as follows. In one case, a voltage 5Vc or −5Vc and a voltage Vc or −Vc are applied once and eleven times, respectively, in total, twelve times. In the other case, a voltage 3Vc or −3Vc and a voltage Vc or −Vc are applied three times and nine times, respectively, in total, twelve times.

These two cases appear for the number of times corresponding to the number of blocks excluding itself, that is, the number of times obtained by subtracting 1 from the total number of blocks.

As described above, FIG. 8 shows the example where the number of row electrodes is 33 (11 rows×3 blocks). For each cycle (S1, S2 . . . ), the selected pixels are ON pixels for applying a voltage of the row 1 of the column electrode voltage pattern shown in FIG. 9D, which corresponds to the above-described case (5). In FIG. 8, a thin line represents a row electrode voltage and a heavy line represents a column electrode voltage. When the row electrode is not selected, the selected pixels are OFF pixels for applying the row electrode voltage on the rows 2 and 3 of the column electrode voltage pattern of FIG. 9D, which correspond to the above-described cases (3) and (10).

The above cases are generalized to obtain an effective voltage in the case where the number of rows is N (N/11 blocks). In the case where N/11 is not an integer, the figures below the decimal point are rounded up. Take Vonsel for a mean square of a voltage to be applied to the ON pixels when the row electrodes are selected, Voffsel for a mean square of a voltage to be applied to the OFF pixels when the row electrode is not selected, Vdesel for a mean square of a voltage to be applied to the pixels when the row electrode is not selected.

The values Von and Voff are given by the following formula (8).

$$V\text{on}=\sqrt{(V\text{onsel}+V\text{desel})}$$

$$V\text{off}=(V\text{offsel}+V\text{desel}) \quad (8)$$

Next, the reason why the value Vdesel is identical both for the ON pixels and the OFF pixels will be described.

At non-selection, neither +Vr nor −Vr but 0 V is applied to the row electrodes. Therefore, the voltage applied to the pixels becomes a voltage pattern itself of the column electrodes. Any one of the cases (1) to (10) is applied to the pixels. The sum of squares is obtained to be the same for the above case (1), case (5), case (6) and case (10). As a result, the following formula (9) is established.

$$(5\times Vc)^2+Vc^2\times 11=36\times Vc^2 \quad (9)$$

Moreover, the sum of squares is obtained to be identical also for the above case (2), case (3), case (4), case (7), case (8) and case (9). As a result, the following formula (10) is established.

$$(3\times Vc)^2\times 3+Vc^2\times 9=36\times Vc^2 \quad (10)$$

For all the cases, the sum of squares is the same. Since these cases appear for the number of times obtained by subtracting 1 from the total number of blocks, a square mean is calculated with the total number of blocks so as to obtain Vdesel as in the following Formula (11).

$$\begin{aligned} Vdesel &= \{36\times Vc^2\times((N/11)-1)/\{(N/11)\times 12\} \\ &= \{3\times N\times Vc^2-33\times Vc^2\}/N \end{aligned} \quad (11)$$

On the other hand, (Vr−5Vc) is applied once and (Vr+Vc) is applied eleven times as voltages to be applied to the ON pixels in the above case (1) at selection. Therefore, a voltage Vonsel, which is a square mean with the total number of blocks, is obtained as in the following Formula (12).

$$\begin{aligned} Vonsel &= \{(Vr-5\times Vc)^2+(Vr+Vc)^2\times 11\}/\{(N/11)\times 12\} \\ &= \{11\times Vr^2+11\times Vr\times Vc+33\times Vc^2\}/N \end{aligned} \quad (12)$$

In the case where the number of column electrodes is N (N/11 blocks), (Vr−3Vc) is applied twice, (Vr+3Vc) is applied once, and (Vr+Vc) is applied nine times as voltages to be applied to the ON pixels in the above case (2) at selection. A voltage Vonsel, which is a mean square with the total number of blocks, is obtained as in the following Formula.

$$\begin{aligned} Vonsel &= \{(Vr-3\times Vc)^2\times 2+(Vr+3\times Vc)^2+(Vr+Vc)^2\times 9\}/ \\ &\quad \{(N/11)\times 12\} \\ &= \{11\times Vr^2+11\times Vr\times Vc+33\times Vc^2\}/N \end{aligned} \quad (13)$$

Similarly, in the case where the number of row electrodes is N (N/11 blocks), (Vr−3Vc) is applied once, (Vr+3Vc) is applied twice, (Vr+Vc) is applied six times, and (Vr−Vc) is applied three times, as voltages to be applied to the ON pixels in the above case (3) at selection. A voltage Vonsel, which is a mean square with the total number of blocks, is obtained as in the following Formula (14).

$$\begin{aligned} Vonsel &= \{(Vr-3\times Vc)^2+(Vr+3\times Vc)^2\times 2+(Vr+Vc)^2\times \\ &\quad 6+(Vr-Vc)^2\times 3\}/\{(N/11)\times 12\} \\ &= \{11\times Vr^2+11\times Vr\times Vc+33\times Vc^2\}/N \end{aligned} \quad (14)$$

Further, in the case where the number of row electrodes is N (N/11 blocks), (Vr+3Vc) is applied three times, (Vr+Vc) is applied three times, and (Vr−Vc) is applied six times as voltages to be applied to the ON pixels in the above case (4) at selection. A voltage Vonsel, which is a square mean with the total number of blocks, is obtained as in the following Formula (15).

$$\begin{aligned} Vonsel &= \{(Vr+3\times Vc)^2\times 3+(Vr+Vc)^2\times 3+(Vr-Vc)^2\times 6\}/ \\ &\quad \{(N/11)\times 12\} \\ &= \{11\times Vr^2+11\times Vr\times Vc+33\times Vc^2\}/N \end{aligned} \quad (15)$$

Further, in the case where the number of row electrodes is N (N/11 blocks), (Vr+5Vc) is applied once, (Vr+Vc) is applied six times, and (Vr−Vc) is applied five times as voltages to be applied to the ON pixels in the above case (5) at selection. A voltage Vonsel, which is a square mean with the total number of blocks, is obtained as in the following Formula (16).

$$\begin{aligned} Vonsel &= \{(Vr+5\times Vc)^2+(Vr+Vc)^2\times 6+(Vr-Vc)^2\times 5\}/ \\ &\quad \{(N/11)\times 12\} \\ &= \{11\times Vr^2+11\times Vr\times Vc+33\times Vc^2\}/N \end{aligned} \quad (16)$$

According to the above-described Formula (8), Von=√(Vonsel+Vdesel) is established. Therefore, Von for all the cases (1) to (5) described so far is as the following Formula (17).

$$Von=\sqrt{[\{11\times Vr^2+11\times Vr\times Vc+3\times N\times Vc^2\}/N]} \quad (17)$$

The Formula (17) is simplified, taking Vc/Vr=A, the following Formula (18) is obtained.

$$Von=(1/\sqrt{N})\times Vr\times\sqrt{\{3\times N\times A^2+11\times A+\mathbf{11}\}} \quad (18)$$

After all, the effective voltages of the ON pixels are all the same.

Similarly, in the case where the number of row electrodes is N (N/11 blocks), (Vr+5Vc) is applied once and (Vr−Vc) is applied eleven times as voltages to be applied to the OFF pixels in the above case (6). A voltage Voffsel, which is a square mean with the total number of blocks, is obtained as in the following Formula (19).

$$\begin{aligned} Voffsel &= \{(Vr+5\times Vc)^2+(Vr-Vc)^2\times 11\}/ \\ &\quad \{(N/11)\times 12\} \\ &= \{11\times Vr^2-11\times Vr\times Vc+33\times Vc^2\}/N \end{aligned} \quad (19)$$

Further, in the case where the number of row electrodes is N (N/11 blocks), (Vr+3Vc) is applied twice, (Vr−3Vc) is applied once, and (Vr−Vc) is applied nine times as voltages to be applied to the OFF pixels in the above case (7). A voltage Voffsel, which is a square mean with the total number of blocks, is obtained as in the following Formula (20).

$$\begin{aligned} Voffsel &= \{(Vr+3\times Vc)^2\times 2+(Vr-3\times Vc)^2+(Vr-Vc)^2\times 9\}/ \\ &\quad \{(N/11)\times 12\} \\ &\quad \{11\times Vr^2-11\times Vr\times Vc+33\times Vc^2\}/N \end{aligned} \quad (20)$$

Similarly, in the case where the number of row electrodes is N (N/11 blocks), (Vr+3Vc) is applied once, (Vr−3Vc) is applied twice, (Vr−Vc) is applied six times, and (Vr+Vc) is applied three times as voltages to be applied to the OFF pixels in the above case (8). A voltage Voffsel, which is a square mean with the total number of blocks, is obtained as in the following Formula (21).

$$Voffsel = \{(Vr+3\times Vc)^2+(Vr-3\times Vc)^2\times 2(Vr-Vc)^2\times 6+(Vr+Vc)^2\times 3\}/\{(N/11)\times 12\} = \{11\times Vr^2-11\times Vr\times Vc+33\times Vc^2\}/N \quad (21)$$

Further, in the case where the number of row electrodes is N (N/11 blocks), (Vr−3Vc) is applied three times, (Vr−Vc) is applied three times, and (Vr+Vc) is applied six times as voltages to be applied to the OFF pixels in the above case (9). A voltage Voffsel, which is a square mean with the total number of blocks, is obtained as in the following Formula (22).

$$Voffsel = \{(Vr-3\times Vc)^2\times 3+(Vr-Vc)^2\times 3+(Vr+Vc)^2\times 6\}/\{(N/11)\times 12\} = \{11\times Vr^2-11\times Vr\times Vc+33\times Vc^2\}/N \quad (22)$$

Further, in the case where the number of column electrodes is N (N/11 blocks), (Vr−5Vc) is applied once, (Vr−Vc) is applied six times, and (Vr+Vc) is applied five times as voltages to be applied to the OFF pixels in the above case (10). A voltage Voffsel, which is a square mean with the total number of blocks, is obtained as in the following Formula (23).

$$Voffsel = \{(Vr-5\times Vc)^2+(Vr-Vc)^2\times 6+(Vr+Vc)^2\times 5\}/\{(N/11)\times 12\} = \{11\times Vr^2-11\times Vr\times Vc+33\times Vc^2\}/N \quad (23)$$

According to the above-described Formula (8), Voff=√(Voffsel+Vdesel) is established. Therefore, Voff for all the cases (6) to (10) described so far is as the following Formula (24).

$$Voff=\sqrt{[\{11\times Vr^2-11\times Vr\times Vc+3\times N\times Vc^2\}/N]} \quad (24)$$

The Formula (24) is simplified, taking Vc/Vr=A, the following Formula (25) is obtained.

$$Voff=(1/\sqrt{N})\times Vr\times\{3\times N\times A^2-11\times A+11\} \quad (25)$$

After all, the effective voltages of the OFF pixels are all the same.

As described above, since all the effective voltage values of the ON pixels are the same while all the effective voltage values of the OFF pixels are the same, the voltage averaging is established.

Next, similarly to the first embodiment, an ideal bias will be described.

A ratio of the effective voltage of the ON pixels Von to the effective voltage of the OFF pixels Voff is as in the following Formula (26).

$$Von/Voff=\sqrt{[\{3\times N\times A^2+11\times A+11\}/\{3\times N\times A^2-11\times A+11\}]} \quad (26)$$

An ideal bias is obtained when the radicand below the radical sign √ in this Formula (26) has its maximum value. Therefore, the radicand is substituted by Y(A) so as to obtain A which maximizes Y.

$$Y(A)=\{3\times N\times A^2+11\times A+11\}/\{3\times N\times A^2-11\times A+11\}$$

The resulting Y(A) is differentiated with respect to A and then is set to 0 so as to obtain a value of A within the range: A>0. Then, A=√/[11/(3×N)] is obtained. The maximum Y(A) is obtained when A=Vc/Vr=√[11/(3×11)] is established. Therefore, substituting A for the above Formula (26), a ratio of Von to Voff is as the following Formula (27).

$$Von/Voff=\sqrt{[\{2\times\sqrt{(3\times N)}+\sqrt{11}\}/\{2\times\sqrt{(3\times N)}-\sqrt{11}\}]} \quad (27)$$

In the above-described second embodiment, the number of simultaneously selected rows is 11. Therefore, for example, in standard high-speed liquid crystal having a threshold voltage of 2.1 V, when the number of row electrodes is 160, a selection voltage Vr can be as low as about 6.1 V.

Therefore, the drive system according to this embodiment has more excellent effects than a conventional drive system.

In contrast with four voltage levels of the column electrodes according to the first embodiment of the first mode of the present invention and six voltage levels of the column electrodes in the second embodiment, the number of voltage levels of the column electrodes according to a conventional drive system is 2 in the APT drive system and the BLA3 drive system, 4 in the IAPT drive system, and 5 in the MLA drive system with L=4. Therefore, merely in view of the number of voltage levels, the drive system of the first mode of the present invention is inferior to the APT drive system and the BLA3 drive system, each having two voltage levels. However, these drive systems are disadvantageous in its high selection voltage and large power consumption. In particular, in the BLA3 drive system, it is apparent that seven or eleven rows cannot be simultaneously driven. If such simultaneous driving is to be realized with two voltage levels, a BAT (binary Addressing Technique) using a row electrode selection pattern including 7 rows and 128 columns or 11 rows and 2048 columns is employed, whereby the display cycle is disadvantageously prolonged.

Moreover, although the IAPT drive system has four voltage levels as in the first embodiment of the first mode of the present invention, there is a problem in that the frame response phenomenon occurs in high-speed liquid crystal as in the APT drive system because a time period until the selection is long.

Moreover, the MLA drive system has five voltage levels even with L=4. Therefore, the first embodiment of the first mode of the present invention having four voltage levels is superior to the MLA drive system. The MLA drive system with L=7 has, as described above, 7+1=8 voltage levels, which is twice the number of voltage levels of the FLA7 drive system of the first embodiment of the first mode of the present invention. Moreover, when the MLA drive system is executed with L=11, the number of voltage levels results in 12, which is also twice the number of voltage levels of the SLA11 of the second embodiment of the first mode of the present invention.

As described above, it is understood that the FLA7 drive system according to the first embodiment of the first mode of the present invention for simultaneously selecting seven rows with four voltage levels of the column electrodes and the SLA11 drive system according to the second embodiment of the first mode of the present invention for simultaneously selecting eleven rows with six voltage levels of the column electrodes have more excellent effects than a conventional system.

As described above in detail, according to the first mode of the present invention, since the number of simultaneously selected row electrodes is 7 and the number of voltage levels of the column electrodes is 4, or the number of simultaneously selected row electrodes is 11 and the number of voltage levels of the column electrodes is 6, the row electrode selection voltage can be lowered. Therefore, a relatively large memory required for display with 4K colors, 65K colors and the like can be incorporated in a fine-process. As a result, the row electrode driver and the column electrode driver can be mounted on a single chip. Furthermore, since the number of voltage levels of the column electrodes is relatively small, i.e., 4 or 6, the size of a chip can be reduced.

Moreover, since the number of row electrodes to be simultaneously driven is large, i.e., 7 or 11, the frame response phenomenon can be prevented even in high-speed liquid crystal having high average response time. Therefore, the higher contrast can be achieved. Moreover, since the row electrode voltage is low, the power consumption is lowered. Furthermore, since the number of simultaneously driven row electrodes is large, an operation frequency is lowered to allow the further reduction in power consumption.

Similarly, it is possible to set the number of simultaneously selected row electrodes to 15 and the number of voltage levels of the column electrodes to 8. As a selection pattern of the row electrodes, an orthogonal function composed of 15 rows and 16 columns is used. The exclusive OR between a 15-bit row electrode vector representing a selection pattern of 15 row electrodes and 15-bit ON/OFF display data representing a display pattern of the column electrodes is obtained for each corresponding bit. The exclusive ORs are added for each bit. Putting one-seventh of the maximum voltage of the column electrodes as Vc, it is preferred to set as follows. When the result of addition is 0 or 1, a voltage level of the column electrodes is −7Vc; when the result of addition is 2 or 3, a voltage level of the column electrodes is −5Vc; when the result of addition is 4 or 5, a voltage level of the column electrodes is −3Vc; when the result of addition is 6 or 7, a voltage level of the column electrodes is −Vc; the result of addition is 8 or 9, a voltage level of the column electrodes is +Vc; when the result of addition is 10 or 11, a voltage level of the column electrodes is +3Vc; when the result of addition is 12 or 13, a voltage level of the column electrodes is +5Vc; and when the result of addition is 14 or 15, a voltage level of the column electrodes is +7Vc.

Although not described in detail, the effective voltage of the ON pixels in such a case is as the following Formula (28).

$$Von=(1/\sqrt{N})\times Vr\times\sqrt{\{4\times N\times A^2+15\times A+15\}} \quad (28)$$

The effective voltage of the OFF pixels is as the following Formula (29).

$$Voff=(1/\sqrt{N})\times Vr\times\sqrt{\{4\times N\times A^2-15\times A+15\}} \quad (29)$$

The ideal bias is as follows.

$$A=Vc/Vr=\sqrt{[15/(4\times N)]}$$

With such an ideal bias, a ratio of Von to Voff is as the following Formula (30).

$$Von/Voff=\sqrt{[\{2\times\sqrt{(4\times N)}+\sqrt{15}\}/\{2\sqrt{(4\times N)}-\sqrt{15}\}]} \quad (30)$$

Deducing from the above, when it is determined that Y is the number of simultaneously selected row electrodes (where Y is an odd number of 7 or more) and an orthogonal function composed of Y rows and Z columns (where Z>Y) is used as a selection pattern of the row electrodes, a voltage level of the column electrodes is an X value, which is expressed by the following Formula (31):

$$[2\times i-(X-1)]\times Vc \quad (31)$$

where i=0, 1, 2, . . . , (X−1), X=(Y+1)/2, and Vc is 1/(X−1) of the maximum voltage of the column electrodes.

The effective voltage of the ON pixels is as the following Formula (32).

$$Von=(1/\sqrt{N})\times Vr\times\sqrt{\{(X/2)\times N\times A^2+Y\times A+Y\}} \quad (32)$$

The effective voltage of the OFF pixels is as the following Formula (33).

$$Voff=(1/\sqrt{N})\times Vr\times\sqrt{\{(X/2)\times N\times A^2-Y\times A+Y\}} \quad (33)$$

The ideal bias is as follows.

$$A=Vc/Vr=\sqrt{[Y/(X/2)\times N)]}$$

With such an ideal bias, a ratio of Von to Voff is as the following Formula (34).

$$Von/Voff=\sqrt{[\{2\times\sqrt{((X/2)\times N)}+\sqrt{Y}\}/\{2\times\sqrt{((X/2)\times N)}-\sqrt{Y}\}]} \quad (34)$$

The multiline addressing drive method and apparatus for passive matrix liquid crystal of the first mode of the present invention are basically constituted as described above.

Next, with reference to FIGS. 10 to 18, a drive method and a liquid crystal driving apparatus for passive matrix liquid crystal of a second mode of the present invention will be described.

Figure 10:
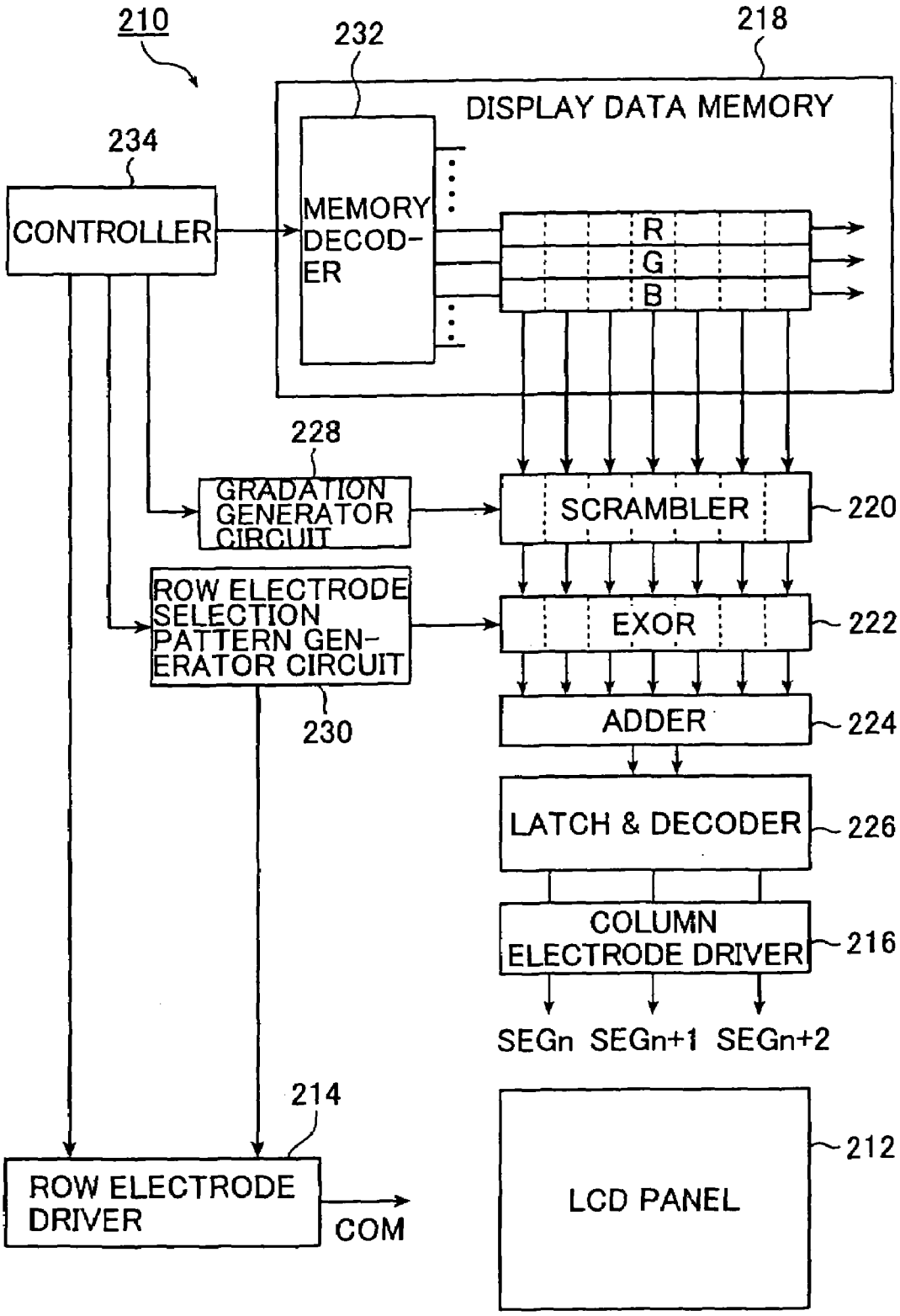
FIG. 10 is a block diagram showing a circuit configuration of an embodiment of a liquid crystal driving apparatus (LCD driver) for implementing a method of driving passive matrix liquid crystal according to a second mode of the present invention.

FIG. 10 is a block diagram showing a circuit configuration of an embodiment of a liquid crystal driving apparatus (LCD driver) for implementing a method of driving passive matrix liquid crystal according to the second mode of the present invention. The LCD driver according to this embodiment employs the MLA drive system, which uses an orthogonal function composed of seven rows and eight columns to simultaneously select seven row electrodes and has four value voltage levels of the column electrodes. This drive method is the FLA7 drive system described above in the first embodiment of the first mode of the present invention. As described above, the MLA drive system simultaneously selects a plurality of row electrodes to apply a row electrode selection pattern and selects a voltage level generated by the row electrode selection pattern and the ON/OFF display data for application to the column electrodes. This field is repeated for the number of row electrode vectors of the row electrode selection pattern to complete a display cycle. In the case of the FLA7 drive system, eight field complete one display cycle.

Note that an LCD driver 210 shown in FIG. 10 basically has a similar structure to that of the LCD driver 10 shown in FIG. 1 except that only one scrambler, EXOR, adder and latch and decoder are provided because RGB are respectively processed in time division instead of being processed for each color of RGB. Moreover, since the components of the LCD drivers are basically the same and have similar functions, the similar components have the same names and reference numerals have the same numerals in the lower two orders of the reference numerals.

As shown in FIG. 10, the LCD driver 210 according to this embodiment includes, as in the embodiment shown in FIG. 1, a row electrode driver 214 for simultaneously selecting seven rows (common; COM) from the row electrodes of the LCD panel 212 and for driving the LCD panel at four column electrode voltage levels, a column electrode driver 216 and a display data memory 218.

Moreover, the LCD driver 210 shown in the same drawing further includes a scrambler 220, an EXOR gate 222, an adder 224 and a latch and decoder (latch & decoder) 226. Since FIG. 10 shows an example where the respective colors of RGB are processed in time division, only one scrambler 220, EXOR gate 222, adder 224 and latch and decoder 226 are respectively provided. Alternatively, as shown in FIG. 1, a set of these components may be provided for each row (segment: SEG) of each color of RGB.

For gradation display, a gradation generator circuit 228 for sending the gradation conversion data to the scrambler 220 and a row electrode selection pattern generator circuit 230 for sending the row electrode selection pattern to the EXOR gate 222 and the row electrode driver 214 are provided. Furthermore, a memory decoder 232 is provided for the display data memory 218. In addition, a controller 234 for controlling each of these components is located.

Color data (any of RGB) for seven rows of the LCD panel 212, which are simultaneously driven, are simultaneously output from the display data memory 218 to the scrambler 220. The scrambler 220 outputs ON/OFF display data corresponding to the gradation conversion data received from the gradation generator circuit 228, respectively. Exclusive ORs between the ON/OFF display data output from the scrambler 220 and the respectively corresponding row electrode selection patterns received from the row electrode selection pattern generator circuit 230 are obtained by the EXOR gate 222, which are in turn added by the adder 224.

The result of addition is input to the latch and decoder 226. Setting one-third of the maximum voltage of the column electrodes to Vc, the voltage level corresponding to the result of addition is selected from four values, −3Vc, −Vc, +Vc, and +3V, by the latch and decoder 226 to be output to the column electrode driver 216. Then, the LCD panel 212 is driven by the row electrode driver 214 and the column electrode driver 216.

As described above, although not particularly limited in this embodiment, it is preferred to use the MLA drive system. This is because the MLA drive system having a large number of selections for unit time is suitable for avoiding the frame response phenomenon, in some cases, the MLA drive system is essential. Furthermore, as the number of selected rows is increased, the number of selections is also increased. Therefore, the above-described FLA7 drive system for simultaneously driving seven rows is preferred. Although the MLA drive system for simultaneously driving seven rows has normally eight column electrode voltage levels, the FLA7 drive system has four voltage levels. Thus, the FLA7 drive method has such an effect that a frequency at which the column electrode voltage varies is nearly halved.

Since the details of the FLA7 drive system have been described in the first embodiment of the first mode of the present invention, the description thereof is herein omitted.

In this embodiment, for implementation of full motion picture (30 frames/second) display, an upper bit of gradation data corresponding to display data is displayed by the PWM gradation system while a lower bit of the gradation data corresponding to the display data is displayed by the FRC gradation system.

Since voltage brightness characteristic of liquid crystal is not linear, the gradation correction is required. In order to display 64 gradations, the minimum necessary data of 64 or more gradations is required. More specifically, 64 gradations are selected from 128 gradations to be gradation data.

However, if the full motion picture display at 128 gradations is performed by the PWM gradation system alone on a liquid crystal panel with 168 rows (7 rows×24 blocks), a minimum divided time period is 1.36 μsec (1/(30 frames×8 fields×24 blocks×128 gradations)). Therefore, the LCD panel cannot respond thereto. As the number of gradations of a full motion picture perceived by the human eyes, 4000 (4K) colors are sufficient. Therefore, it is sufficient that each color (R, G, B) has 16 gradations (16×16×16=4096). Thus, high-order 4 bits of the gradation data (16 gradations) are displayed by the PWM gradation system.

On the other hand, since the display of a letter, a slow motion picture or a static picture requires high image quality, 128-gradation data is fully displayed. Therefore, in this embodiment, lower-order 3 bits of the 128-gradation data is displayed by eight ON and OFF operations (eight gradations). Then, the low-order 3 bits are allocated to a minimum divided time of the PWM gradation system to be added to the PWM gradation method.

In this manner, a method in which the FRC gradation system is added to (plus) the PWM gradation method is herein referred to as a PpF (PWM plus FRC) gradation system.

The inventor of the present application has now developed a gradation system compatible to a full motion picture (30 frames/second) for displaying 260,000 colors with RGB, selecting 64 gradations from 128 gradations (7 bits), including the correction of voltage brightness characteristics of liquid crystal. The developed system is the PpF gradation system in which the FRC gradation system is added to (plus) the PWM gradation system.

According to this PpF gradation system, the excellent effects as follows can be obtained: an operation frequency can be reduced to ¼ or ⅛; the power consumption is remarkably reduced; the power consumption is not increased even for display of a full motion picture; and the gradation data to be stored is as small as 4608 bits, which is about ⅕ of conventional display.

In this embodiment, an LCD driver (liquid crystal driving apparatus) employing the PpF gradation system, for 260,000 colors-STN-LCD will be described by way of example.

As described above, in the PpF gradation system of this embodiment, 64 gradations are selected from 128 gradation (7 bits). The high-order 4 bits are expressed by the PWM gradation system while the low-order 3 bits are expressed by the FRC gradation system. Then, the FRC is allocated to the minimum divided time of PWM to be added to the PWM gradation method. Moreover, a necessary row selection time period is set to a multiple of 8.

For example, it is now assumed that the maximum number of gradations is 107. In this case, a row selection time period is set to, for example, a multiple of 8 larger than 107, for example, 112 (14×8) gradations, and the mapping is performed at 112 gradations. The row selection time period is divided into 14 as sequences 0 to 13. Then, the low-order 3 bits are expressed by the sequence 0 in the FRC gradation system, whereas the high-order 4 bits are expressed by the sequences 1 to 13 in the PWM gradation system.

Figure 11:
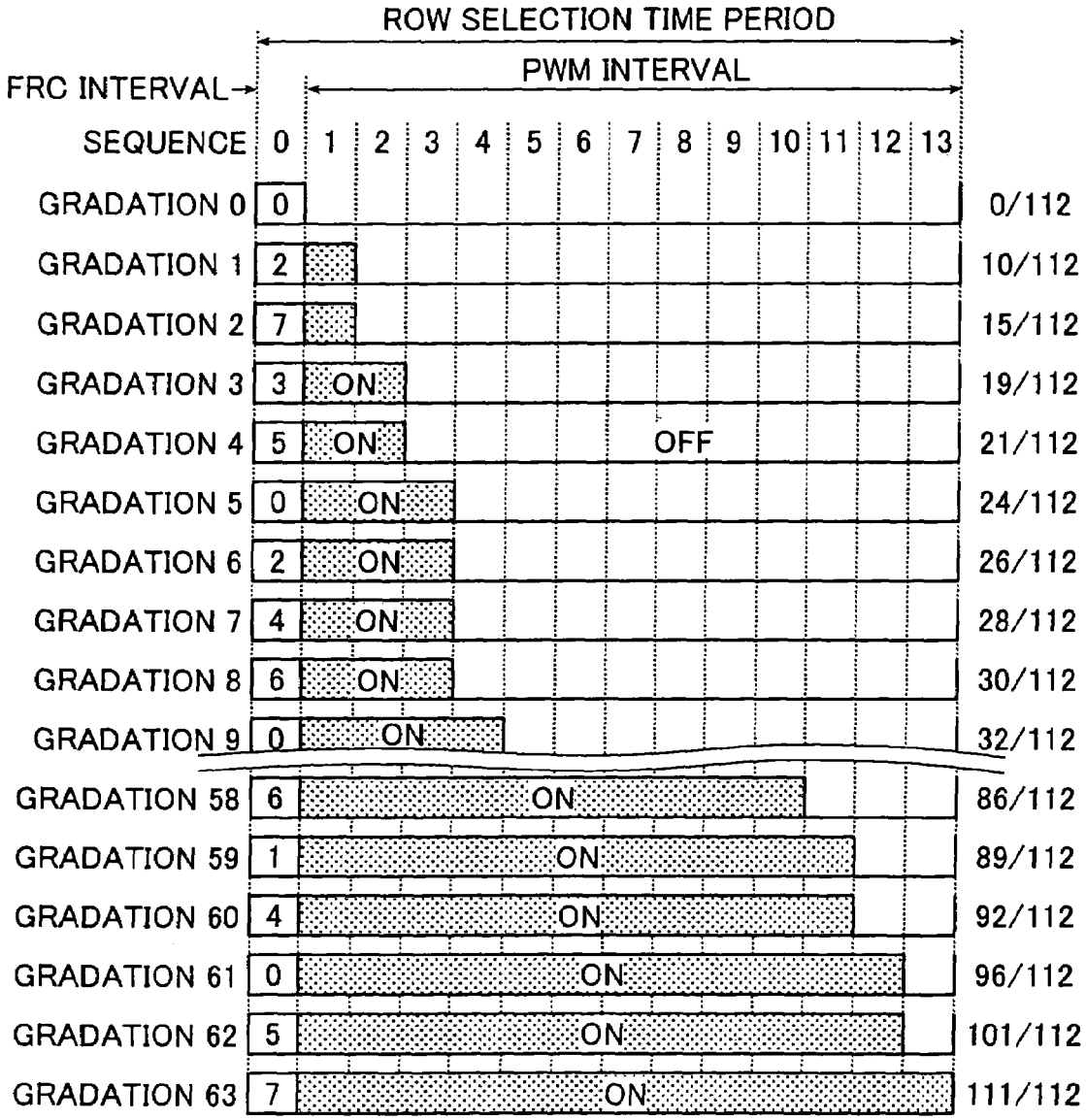
FIG. 11 is an explanatory view showing an example of a drive method employing a continuous time PWM gradation system in the embodiment shown in FIG. 10.

FIG. 11 shows an example of a drive method by a continuous time PWM gradation system.

FIG. 11 shows an example of G (green) with 14 sequences. Its values are set to a gradation pallet. R (red) and B (blue) are similarly set to the gradation pallet, using the gradations 0 to 13.

Since eight types of the row electrode selection patterns (for example, column vectors) are used to perform an MLA calculation on the ON/OFF display data of each sequence, eight fields complete a display cycle. In the continuous time PWM gradation system, however, as shown in FIG. 11, all the gradations are turned ON at a time and turned OFF in accordance with the display data memory and the set gradation pallet. Then, all the gradations are turned ON at a time again. Therefore, in the case where a repeated frequency of a display cycle is low (for example, 35 Hz or lower), the flicker may be visible. As countermeasure to deal with the flicker, a distributed PWM gradation system, in which ON time period of the PWM gradation system is distributed within a PWM interval of the row selection period, may be conceived.

Figure 12:
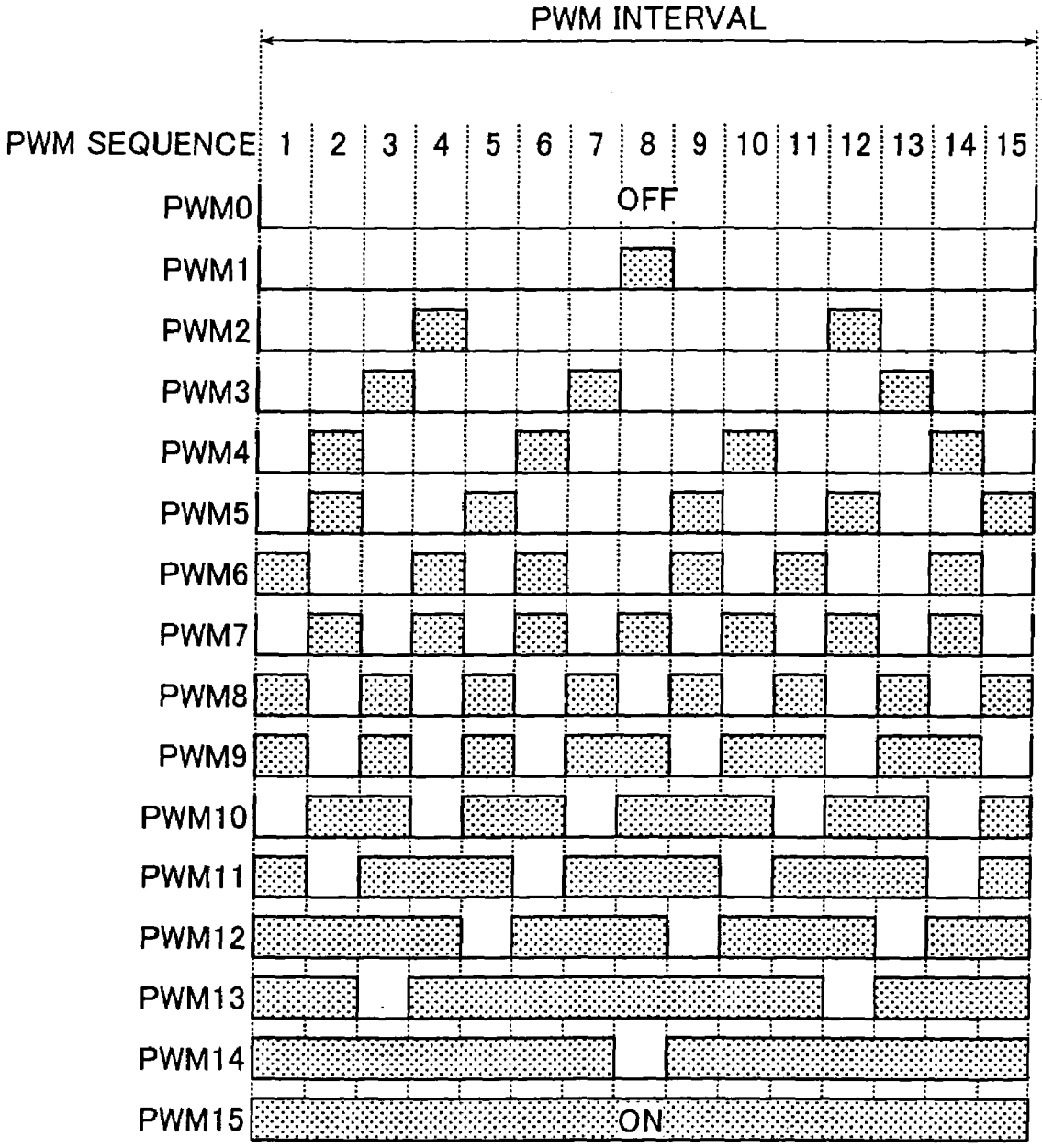
FIG. 12 is an explanatory view showing an example of a drive method employing a distributed PWM gradation system in the embodiment shown in FIG. 10.

FIG. 12 shows an example of a drive method according to the distributed PWM gradation system.

In the example shown in FIG. 12, the number of sequences is fixed to 16. Moreover, ON positions in the sequences 1 to 15 are distributed within the PWM interval in accordance with the PWM values to prevent the flicker.

Figure 13:
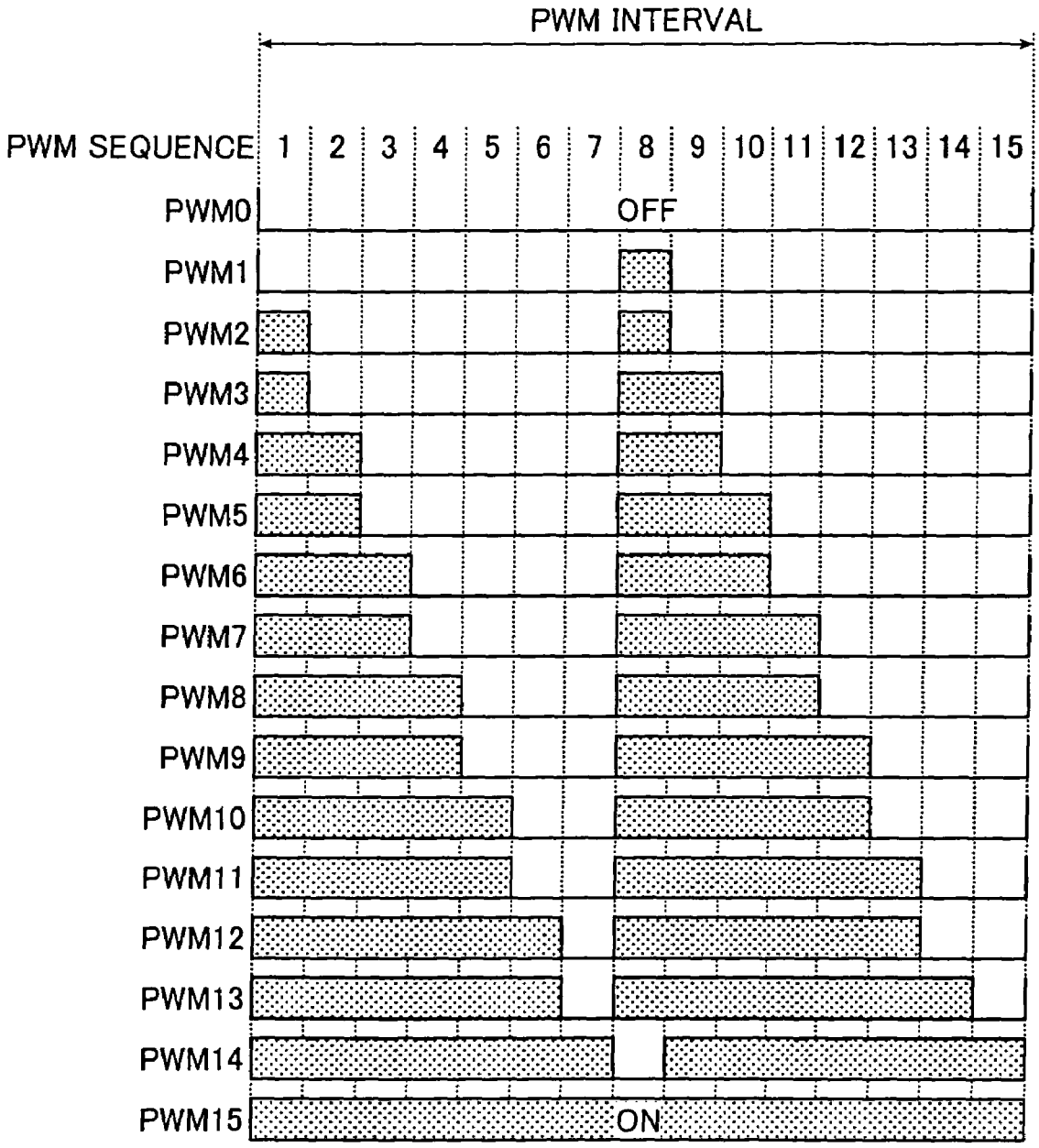
FIG. 13 is an explanatory view showing another example of a drive method employing the distributed PWM gradation system in the embodiment shown in FIG. 10.

However, if the number of distributions is excessively increased to increase a frequency at which the segment voltage varies, resulting in noticeable crosstalk, the ON positions may be distributed in two sections as shown in next FIG. 13.

Figure 14:
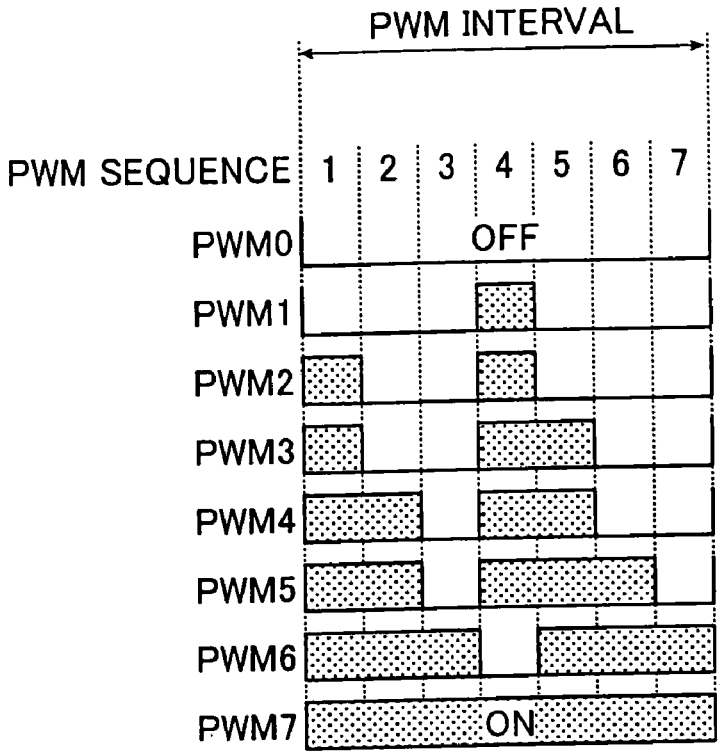
FIG. 14 is an explanatory view showing an example of a drive method employing the distributed PWM gradation system in the case of 64 gradations in the embodiment shown in FIG. 10.

Moreover, in the case where 64 gradations are sufficient instead of 128 gradations, the number of sequences is fixed to 8. At this point, as shown in FIG. 14, the ON positions of the sequences 1 to 7 are distributed in two sections within PWM interval in accordance with the PWM values.

Figure 15:
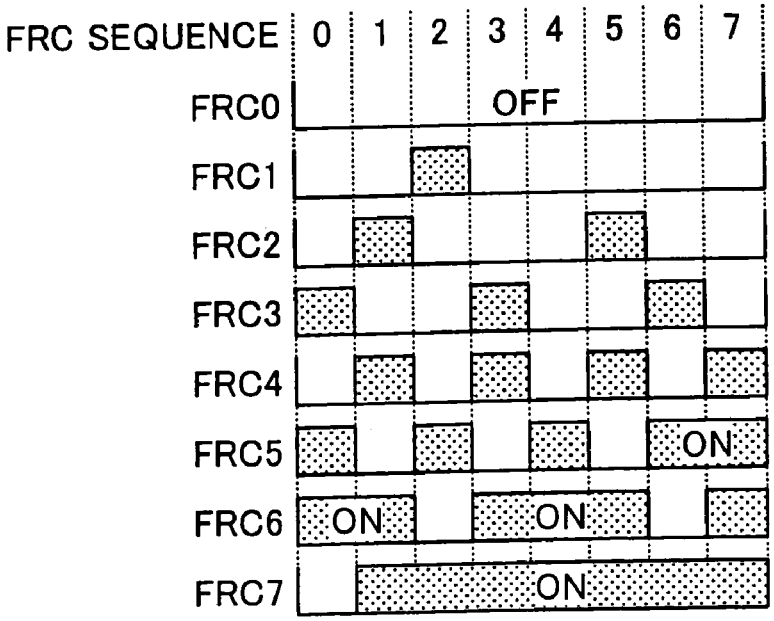
FIG. 15 is an explanatory view showing an example of a drive method (ON/OFF control) in an FRC interval in the embodiment shown in FIG. 10.

Within an FRC interval, ON/OFF in each sequence is controlled in accordance with its value for each FRC sequence, as shown in FIG. 15. Since the FRC sequence is updated for each field and shifts for every 8 fields, ON and OFF periods are averaged to reduce the flicker.

Since eight types of the row electrode selection patterns (for example, column vectors) are used to perform an MLA calculation on the ON/OFF data of each FRC sequence, for example, 64 fields (8×8) complete one display cycle in the case of an orthogonal function composed of 7 rows and 8 columns. In motion picture display, the color reproducibility is degraded or the transient variation in brightness (splicing) occurs in some cases because the display data is overwritten so as not to complete the MLA calculation during 64 fields.

In this case, as shown in FIG. 15, the FRC interval is fixed to the above-described FRC sequence 7 (the uppermost bit of the lower-order 3 bits) by designation. Since the FRC is complete with 8 fields, the occurrence of splicing is reduced while the reduction in color reproducibility is less even when the display data is changed.

Ultimately, the low-order 3 bits are rounded by counting fractions over four-tenth as one and disregarding the rest. Equivalently, the FRC time period becomes one of the PWM time periods, so that the high-order 4 bits becomes 4.5 bits. For R, G and B, 12 bits become 13.5 bits, resulting in 11K colors. As the number of gradations of a full motion picture which can be perceived by the human eyes, such a number of gradations are sufficient.

As an example of application of the PpF gradation method, it is conceivable that a screen of a portable telephone is divided into a region for a letter or a slow motion picture and a full motion picture region for display.

Figure 16:
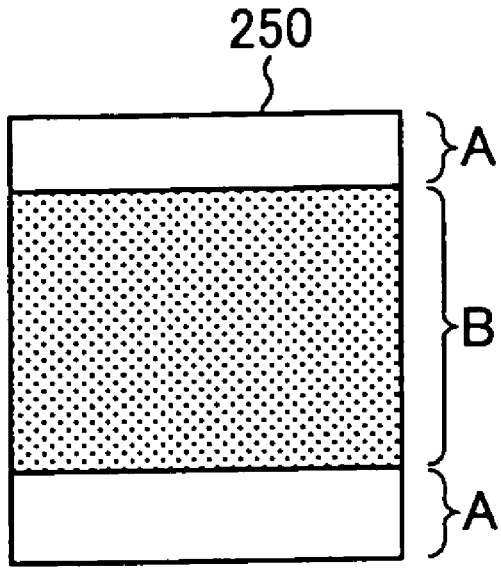
FIG. 16 is an explanatory view showing an example of a screen divided into an FRC unfixed area where a letter, a static picture and the like is displayed and an FRC fixed area where a full motion picture is displayed, in the embodiment shown in FIG. 10.

For example, as shown in FIG. 16, a screen 250 of a portable telephone is divided into an FRC non-fixed area A for displaying a letter, a static picture or a slow motion picture and an FRC fixed area B for displaying a full motion picture. In this manner, a full motion picture can be displayed on the FRC fixed area B on the screen 250.

Figure 17:
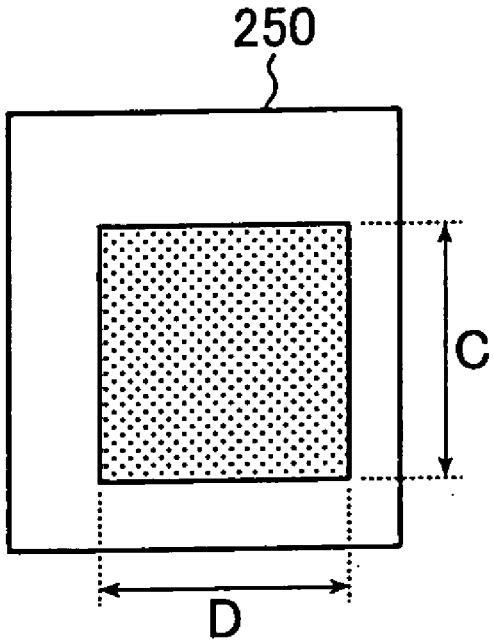
FIG. 17 is an explanatory view showing an example of a screen whose FRC fixed area is arbitrarily designated in the embodiment shown in FIG. 10.

Alternatively, as shown in FIG. 17, when the FRC fixed area is designated by the row electrode and the column electrodes as an FRC fixed area C of the row electrode and an FRC fixed area D of the column electrode, a full motion picture can be displayed at an arbitrary position on the screen 250.

Hereinafter, the functions of a liquid crystal driving apparatus 210 shown in FIG. 10 will be described.

The controller 234 designates the display data of a block to be displayed on the LCD panel 212 to the memory decoder 232 of the display data memory 218. Then, the display data (R, G, B) for the selected seven rows are sent from the display data memory 218 to the scrambler 220.

The scrambler 220 determines if a gradation represented by the display data is ON or OFF in the sequence in question, based on the gradation conversion data sent from the gradation generator circuit 228 to output it as ON/OFF display data.

The generation of the gradation conversion data in the gradation generator circuit 228 will be described with reference to FIG. 18.

As shown in the drawing, the gradation generator circuit 228 includes a PWM gradation pallet 236, an FRC gradation pallet 238, a sequencer 240, an FRC sequencer 242 and a gradation selector 244.

Figure 18:
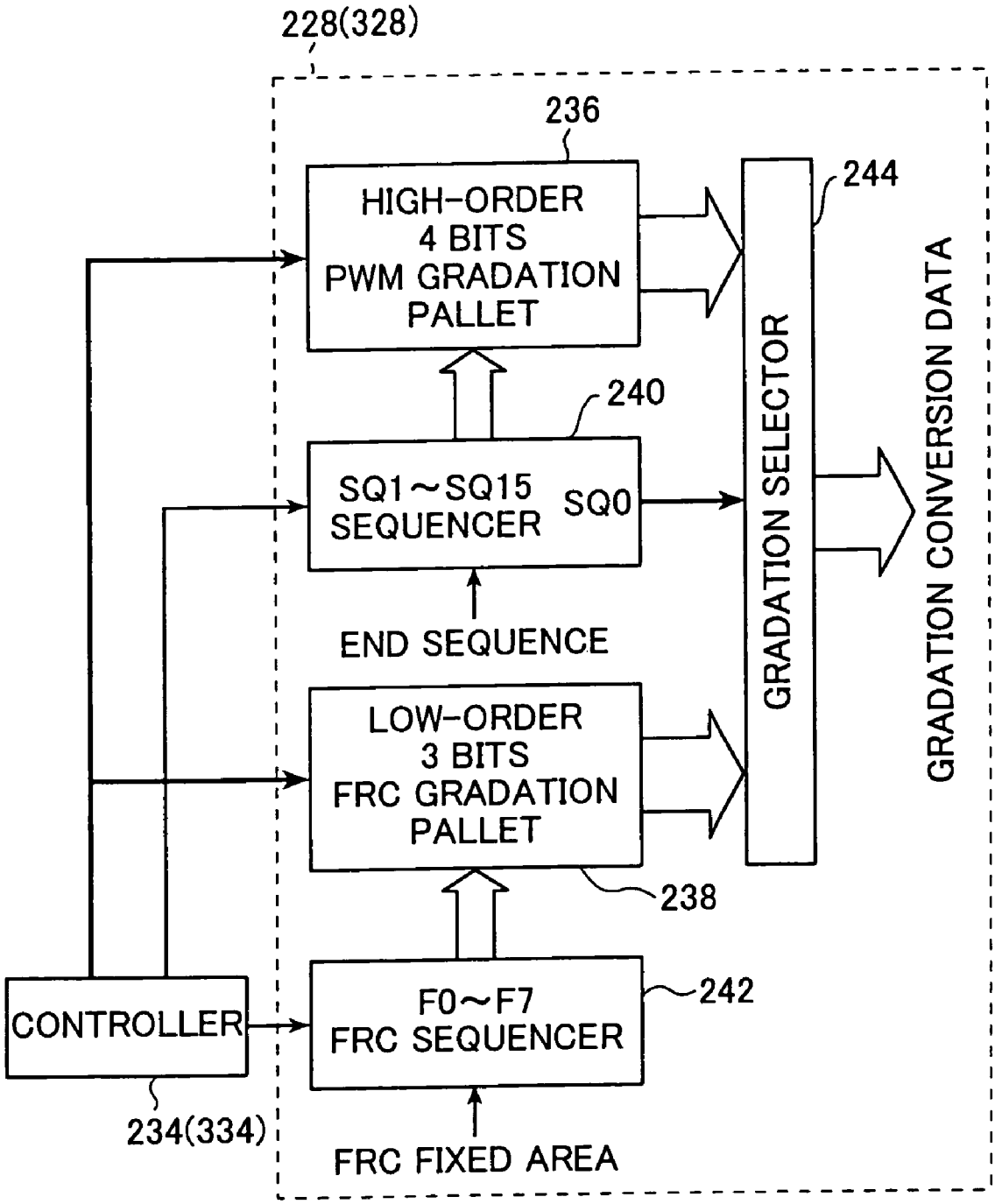
FIG. 18 is a block diagram showing a gradation generator circuit for generating gradation conversion data in the embodiment shown in FIG. 10.

As shown in FIG. 18, the controller 234 sets the high-order 4 bits of the gradation data of 64 gradations specified from the 128 gradations, to the PWM gradation pallet 236 while setting the low-order 3 bits of the gradation data to the FRC gradation pallet 238.

The sequencer 240 generates sequence signals (SQ0 to SQ15) in accordance with a clock from the controller 234 and an end sequence value. The PWM gradation pallet 236 outputs ON/OFF data of each gradation (gradations 0 to 63) at the time of each of the sequences (SQ1 to SQ15).

The FRC sequencer 242 generates FRC sequence signals (F0 to F7) in accordance with a clock from the controller 234 and the designation of the FRC fixed area. In the case where the FRC sequence signal corresponds to the FRC fixed area, it is fixed to F7 corresponding to the uppermost bit among the low-order 3 bits.

The FRC gradation pallet 238 outputs ON/OFF data of each of the gradations (gradations 0 to 63) at the time of each of the FRC sequences (F0 to F7).

The gradation selector 244, in the case of SQ0, outputs ON/OFF data from the FRC gradation pallet 238, and in the case of SQ1 to SQ15, outputs ON/OFF data from the PWM gradation pallet 236, as the gradation conversion data.

In this manner, the representation in the FRC gradation system is allocated to minimum divided time in the PWM gradation system, thereby adding the FRC gradation system to the PWM gradation system.

Returning to FIG. 10, the controller 234 designates the row electrode selection pattern to be used at this point of time to the row electrode selection pattern generator circuit 230.

The row electrode selection pattern generator circuit 230 sends the row electrode selection pattern to the EXOR gate 222 and the row electrode driver 214. In the EXOR gate 222, exclusive ORs (EXOR) between the ON/OFF display data from the scrambler 220 and the row electrode selection pattern are obtained. The result of EXOR calculations are added in the adder 224 to be latched in the latch and decoder 226.

The column electrode voltage level is selected by the latched value to be supplied to each column electrode by the column electrode driver 216.

On the other hand, for the selected block, the row electrode voltage in accordance with the row electrode selection pattern is supplied to the row electrodes by the row electrode driver 214, thereby driving the LCD panel 212.

As described above, according to this embodiment, a slow motion picture or a static picture at multi-gradation levels (260,000 colors) can be displayed on STN liquid crystal. At the same time, a full motion picture (30 frames/second) of 4K colors or more can be displayed.

Moreover, since the row selection time period is sufficiently long and a frequency at which the column electrode voltage varies is low, the STN liquid crystal is capable of responding thereto. As a result, the deterioration in contrast can be reduced.

Furthermore, since the ON positions in the PWM interval are distributed, the flicker is decreased even if a repeated frequency of the display cycle is reduced.

Furthermore, since the operation frequency can be gradually reduced, the power consumption is remarkably small. Even in full motion picture display, the power consumption is not increased.

In addition, since a region where a full motion picture is to be displayed can be arbitrarily designated, this system is compatible with various applications. The splicing is reduced because the FRC gradation display can be stopped. This embodiment has the effect that the degradation in color reproducibility due to incompletion of the MLA calculation is reduced.

Thus, this PpF gradation system is an extremely effective system capable of realizing multicolor, high image quality, compatibility to motion pictures, low power consumption, low price and the like, which are commercial requirements, in particular, for an LCD module for portable telephone.

In the display cycle of the FRC gradation system, one ON pixel or OFF pixel is calculated by all column vectors for display, which operation is executed for all ON pixels or OFF pixels. For example, in the case where the number of simultaneously selected rows is 7 and an orthogonal function composed of 7 rows and 8 columns is used, one gradation is displayed by 640N/OFF operations (6-bit 64-gradation data). Then, one display cycle is displayed by 512 (8×64) ON/OFF operations. In order to display 168 rows (24 blocks) in a full motion picture (30 frames/second), the LCD panel must respond to a frequency of about 369 kHz (512×24×30).

On the other hand, in the case of 7 rows and 8 columns, for example, the display cycle in the PWM gradation system is composed of 8 fields. In the case of 64 gradations, one gradation is expressed by ON time of a time period divided in 63 sections. In order to display 168 rows (24 blocks) in a full motion picture, the LCD panel must respond to a frequency of about 363 kHz (63×8×24×30).

Moreover, since the brightness characteristic with respect to a pulse width of liquid crystal is not linear, 64 or more pulse widths (gradation data) are required for correction to display 64 gradations. More specifically, each of the display data of 64 gradations is selected from 128 gradation data to correspond to as the gradation data. Therefore, a frequency is further more increased (doubled).

However, at present, an LCD panel capable of responding to such a high frequency does not exist. Moreover, since the operation frequency is increased, the power consumption is correspondingly increased. Although the FLA7 drive system has an effect of nearly halving a column frequency to liquid crystal because the number of kinds of row electrode voltages is 4 instead of 8, the power consumption cannot be reduced as expected.

On the other hand, as described above, the PpF gradation system is a gradation system compatible with a full motion picture, for selecting 64 gradations from 128 gradation data including the correction for the voltage brightness characteristic of liquid crystal to display 260,000 colors with RGB. With this system, the operation frequency can be reduced to one-fourth, i.e., 92 kHz (16×8×24×30), thereby remarkably reducing the power consumption. The power consumption is not increased even for a full motion picture. Moreover, this system has an effect that 4608 bits are sufficient as a storage capacitance for storing the gradation data of R, G and B.

The drive method and the liquid crystal driving apparatus for passive matrix liquid crystal of the second mode of the present invention are basically constituted as above.

Next, with reference to FIGS. 19 to 24, multiline addressing driving apparatus and method for passive matrix liquid crystal of the third mode of the present invention will be described.

The third mode of the present invention is for eliminating horizontal brightness unevenness (COM stripe) peculiar to the MLA drive system, by allocating a set of orthogonal functions (orthogonal function set) obtained by rotating row vectors of the orthogonal function to the respective divided selection time periods obtained by dividing a selection time period of one row electrode (hereinafter, referred to simply as a row selection time period) into a plurality of sections while all the column vectors of the allocated orthogonal function loop back in time series through the row electrodes of the respective divided selection time periods, in the MLA drive system for simultaneously driving a plurality of rows of passive matrix liquid crystal using an orthogonal function.

Figure 19:
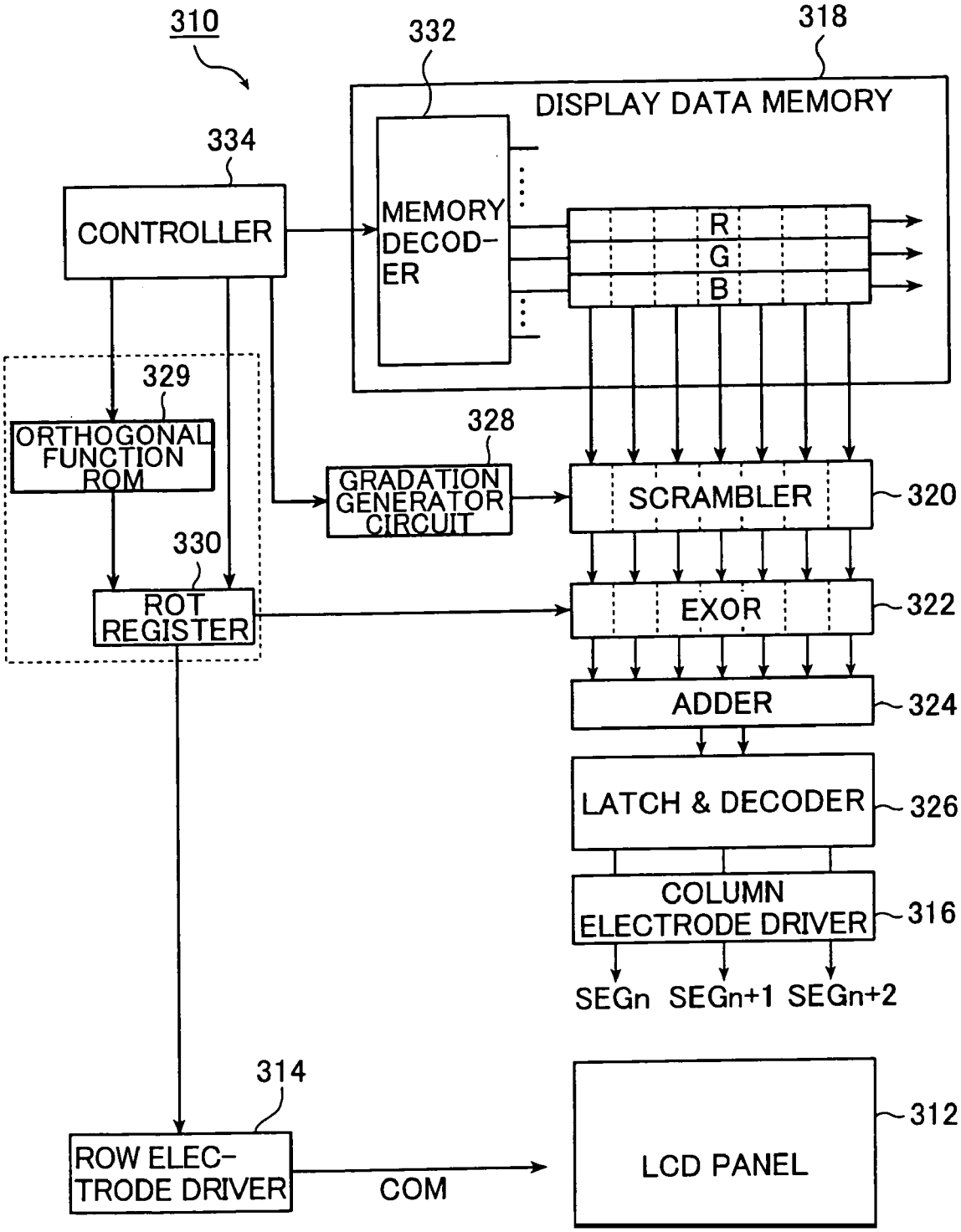
FIG. 19 is a block diagram showing a circuit configuration of an embodiment of an apparatus (LCD driver) for implementing a multiline addressing drive method for passive matrix liquid crystal according to a third mode of the present invention.

FIG. 19 is a block diagram showing a circuit configuration of one embodiment of a liquid crystal driving apparatus (LCD driver) for implementing a multiline addressing drive method for passive matrix liquid crystal according to a third mode of the present invention. The LCD driver according to this embodiment simultaneously selects seven row electrodes and has four voltage levels of the column electrodes. This drive method is the FLA7 drive system described above in the first embodiment of the first mode of the present invention.

An LCD driver 310 shown in FIG. 19 basically has a similar structure to that of the LCD driver 210 shown in FIG. 10 except that an orthogonal function ROM 329 and an ROT register 330 are included in place of the row electrode selection pattern generator circuit 230. Moreover, since the components of the LCD drivers are basically the same and have similar functions, the similar components have the same names and the reference numerals have the same numerals in the lower two orders of the reference numerals. The detailed description thereof is herein omitted.

As shown in FIG. 19, the LCD driver 310 according to this embodiment employs the MLA system for simultaneously selecting seven rows (common) of the LCD panel 312 to drive the LCD panel at four voltage levels of the column electrodes. The LCD driver includes a row electrode driver 314, a column electrode driver 316 and a display data memory 318.

Moreover, the LCD driver 310 shown in the same drawing further includes a scrambler 320, an EXOR gate 322, an adder 324 and a latch and decoder (latch & decoder) 326. Since FIG. 19 shows an example where each color of RGB is processed in time division, only one scrambler 320, EXOR gate 322, adder 324 and latch and decoder 326 are respectively provided. However, as shown in FIG. 1, these components may be provided in each column (segment) for each color of RGB.

For gradation display, a gradation generator circuit 328 for sending the gradation conversion data to the scrambler 320 is provided. The scrambler 320 receives the gradation conversion data from the gradation generator circuit 328.

The orthogonal function ROM 329 and the ROT register 330 for rotation of row vectors of the orthogonal function, which produces a selection pattern of the simultaneously selected row electrodes, are provided, which is the important point of the present invention. The orthogonal function ROM 329 stores an initial value of a column vector of the orthogonal function. The ROT register 330 rotates a bit of an initial value of this column vector to send it to the EXOR gate 322 and the row electrode driver 314. Although the specific operation will be described below, a desired row electrode selection pattern is achieved by this rotation.

Furthermore, a memory decoder 332 is provided for the display data memory 318.

Moreover, a controller 334 for controlling each of these components is placed.

Color data (any of RGB) for seven rows of the LCD panel 312, which are simultaneously driven, are simultaneously output from the display data memory 318 to the scrambler 320. The scrambler 320 outputs ON/OFF display data corresponding to the input gradation conversion data, respectively. Exclusive ORs between the ON/OFF display data output from the scrambler 320 and the respectively corresponding row electrode selection patterns received from the ROT register 330 are obtained by the EXOR gate 322, which are in turn added by the adder 324.

The result of addition is input to the latch and decoder 326. Setting one-third of the maximum voltage of the column electrodes to Vc, the voltage level corresponding to the result of addition is selected from four values, −3Vc, −Vc, +Vc, and +3V, by the latch and decoder 326 to be output to the column electrode driver 316. Then, the LCD panel 312 is driven by the row electrode driver 314 and the column electrode driver 316.

As described above, in this embodiment, the MLA drive system, in particular, the FLA7 drive system is used. The description of the details of the MLA drive system and the FLA7 drive system are omitted below because they have been described in the first embodiment of the first mode of the present invention.

Herein, the case where an LCD panel including 168 row electrodes (7 rows×24 blocks) or 128 row electrodes (7 rows×19 blocks) is driven by the FLA7 drive system is considered. It is assumed that the orthogonal function is represented by, for example, an orthogonal matrix composed of 7 rows and 8 columns as shown in FIG. 2.

At this moment, eight column vectors (R1 to R8) of the orthogonal function must be updated in time series. Then, each block (or row) must use all the column vectors during one display cycle.

There are two methods for updating the column vectors.

The first method is a block update mode for updating the column vectors for each block serving as a unit (set) of the simultaneously selected row electrodes.

FIG. 20 shows the update of the column vectors in the block update mode. In FIG. 20, the number of row electrodes is 168. When seven rows are simultaneously selected, 168÷7=24 blocks are formed. These blocks are denoted as blocks 0 to blocks 23. In the example shown in FIG. 20, 8 fields, i.e., eight scans over a screen from the upper side to the lower side, complete one display cycle. At this moment, in the block update mode, the column vectors are updated for each block consisting of seven rows in each of the fields.

The other method of updating the column vectors is a field update mode for updating the column vectors for each field.

FIG. 21 shows the update of the column vectors in the field update mode.

FIG. 21 shows the case with 128 row electrodes and 19 blocks when seven rows are simultaneously selected. As shown in FIG. 21, in the field update mode, the same column vector is used for all the blocks 0 to 18 in one field. Then, with the change of a field, the column vector is updated.

The above-mentioned PpF gradation system, in which the FRC gradation system is added to the PWM gradation system, is applied to this embodiment as a gradation driving system for passive matrix liquid crystal. This PpF gradation system is the gradation system for passive matrix liquid crystal, which has already been proposed by the inventor of the present invention in the second mode of the present invention. As described above, in this PpF gradation system, the upper bits of the gradation data are displayed by the pulse width modulation (PWM) gradation system while the lower bits of the gradation data are displayed by the frame rate control (FRC) gradation system to be allocated to minimum divided time of the PWM gradation system so that the FRC gradation system is added to the PWM gradation system.

Since the details of the PpF gradation system have been described in the second mode of the present invention, the description thereof will be omitted below.

Hereinafter, a method of eliminating the horizontal brightness unevenness peculiar to the MLA drive system by rotation of row vectors, which is the important point of the present invention, will be described.

First, the horizontal brightness unevenness will be described. Although each pixel has an equal effective voltage in terms of calculation, the brightness unevenness occurs in a horizontal direction of a screen in accordance with column vectors to the respective rows in time series. This horizontal brightness unevenness, which is referred to as "COM stripe", appears in a noticeable manner when a frequency of the display cycle is low and full white display is performed. This horizontal brightness unevenness is less visible by updating the column vectors of the orthogonal function in the block updating mode for each block. However, when the LCD panel is shaken, the brightness unevenness is visible again as a "shake stripe". Moreover, when the period of the display cycle is accelerated (for example, about 60 cycles), this brightness unevenness is eliminated.

This horizontal brightness unevenness is a problem peculiar to the MLA drive system, and the reason for its occurrence is not elucidated. However, it is supposed that the horizontal brightness unevenness is caused by a kind of optical response characteristics due to a difference in a pattern between the row electrode voltage and the column electrode voltage which are applied to liquid crystal in time series.

For example, the display on an LCD panel is performed by using a Walsh function composed of seven rows and eight columns as shown in FIG. 22 as an orthogonal function. At this time, a row electrode 1 is displayed brighter than the other row electrodes. Even when the polarity of a row vector L1 of the row electrode 1 is inverted, the row electrode 1 is still displayed brighter than the other row electrodes. When the polarity of a column vector R6 of a cycle #6 is inverted, the brightness of the row electrode 1 is attenuated, but still brighter than the other row electrodes. When the column vector R6 is moved ahead of a column vector R2 while column vectors R2 to R5 are shifted behind, the brightness of the row electrode 1 is eliminated while a row electrode 6 becomes slightly brighter and a row electrode 7 becomes slightly darker. When the row vectors L1 to L7 are rotated, the bright row electrode rotates along therewith. Even when the column vectors R1 to R8 are rotated, the row electrode 1 is displayed brighter than the other row electrodes.

Therefore, a method of eliminating the horizontal brightness unevenness will be described below.

First, a selection time period for the row electrodes (row selection time period) is divided into a plurality of divided selection time periods. Then, a set of orthogonal functions obtained by rotating the row vectors of the orthogonal function are allocated to the respective divided selection time periods. Then, during a display cycle, all the column vectors of the allocated orthogonal function are made to loop back through the row electrodes of each of the divided selection time periods in time series.

This operation is described by using a specific example.

FIG. 23 shows a set of orthogonal functions (A to G) obtained by rotating below two rows of the orthogonal function A at each time.

For example, as shown in FIG. 24, it is assumed that a row selection time period consists of 14 sequences (sequences 0 to 13). These 14 sequences are divided into seven divided selection time periods, each consisting of 2 sequences. Then, each orthogonal function of a set of the orthogonal functions, in which the row vectors L1 to L7 are rotated by two rows, is allocated to each divided selection time period.

More specifically, the orthogonal function A corresponds to a first divided selection time period A consisting of sequences 0 and 1. The row vectors L1 to L7 respectively correspond to the row electrodes 1 to 7 from the upper direction. Correspondingly, the orthogonal function B corresponds to a second divided selection time period B consisting of sequences 2 and 3. The row vectors are shifted below by two rows, that is, the row vector L1 corresponds to the row electrode 3, and the row vectors L6 and L7 correspond to the row electrodes 1 and 2. In a similar manner, the orthogonal functions (C to G) respectively correspond to the divided selection time periods (C to G) below.

One column vector of the column vectors (R1 to R8) is designated to a row selection time period of one field. All the column vectors loop back in eight fields to complete a display cycle.

As shown in FIG. 24, as a result of the above rotation, all the row vectors L1 to L7 are present within the row selection time period of each row electrode. Therefore, even if the horizontal brightness unevenness is present, it is averaged in terms of time. Since all the row electrodes (row electrodes 1 to 7) have the same conditions, the horizontal brightness unevenness peculiar to the MLA drive system is eliminated.

Although the number of divided selection time periods and the number of the orthogonal function included in the orthogonal function set obtained by rotation are ideally identical with each other, i.e., 7 in the example shown in FIG. 24, they are not particularly required to be the same. When the number of divided selection time periods is increased, the brightness is ensured to be averaged as compared with the case where the number of divided selection time periods is smaller. In this case, however, since the voltage levels applied to the row electrodes and the column electrodes are more frequently varied, the power consumption is increased. On the other hand, if the number of divided selection time periods is small, the power consumption is reduced, but the effect of averaging the brightness is smaller.

In portable appliances, however, since the reduction in power consumption has priority, it is preferred that the number of divided selection time periods is smaller. Deducing from these facts, it is preferred to divide the row selection time period by an integer value (in this case, 2 or more, that is, 2, 3, 4 and so on) larger than an integer value (in this case, 2) of a quotient (16÷7=2.29) obtained by dividing the number of sequences (for example, 16) by the number of simultaneously selected rows (for example, 7). In practice, since the degree of brightness unevenness differs depending on liquid crystal and the orthogonal function, the number of divisions may be ultimately determined on view of brightness unevenness.

Two row vectors are rotated at each time in the above-described example, the number of rotated rows is not particularly limited thereto. The number of rotated rows or the orthogonal function may be changed in accordance with the degree of brightness unevenness.

Hereinafter, the function of the liquid crystal driving apparatus (LCD driver) 310 shown in FIG. 19 will be described.

The controller 334 designates the display data of a block to be displayed on the LCD panel 312 to the memory decoder 332 of the display data memory 318. Then, the display data (R, G, B) for selected seven rows are sent from the display data memory 318 to the scrambler 320.

The scrambler 320 determines whether the gradation represented by the display data is ON or OFF in the sequence in question based on the gradation conversion data sent from the gradation generator circuit 328.

Since the generation of the gradation conversion data has been described in detail in the embodiment of the second mode of the present invention with reference to FIG. 18, the description thereof is omitted in the embodiment of the third mode of the present invention. The reference numerals 234 and 228 of the controller and the gradation generator circuit in FIG. 18 in the description of the second mode of the present invention may be replaced by 334 and 328 in the third mode of the present invention.

As described above, there are a block update mode and a field update mode for updating the column vectors. In any case, all the column vectors used in each block loop back through the display cycle.

Returning to FIG. 19, at the beginning of the sequence 0 (see FIG. 24), the controller 334 selects 7 bits of the initial values of the column vector from the orthogonal function ROM 329 in accordance with the update mode to load the selected 7 bits to the ROT register 330. Moreover, 7 bits of the ROT register 330 are rotated for each of a predetermined number of sequences (divided selection time periods). As a result, the row vectors of the orthogonal function are rotated.

The elements of the column vector corresponding to the row electrode selection pattern are sent from the ROT register 330 to the EXOR gate 322 for each selection time period.

In the EXOR gate 322, exclusive ORs (EXOR) between the ON/OFF display data from the scrambler 320 and the column vector elements rotated in correspondence with the row electrode selection pattern are obtained. The results of the EXOR calculations are added in the adder 324, and are then latched in the latch and decoder 326.

The column electrode voltage level is selected based on the latched value to be supplied to each of the column electrodes by the column electrode driver 316.

On the other hand, for the selected block, the row electrode voltage in accordance with the rotated column vector is supplied to the row electrodes by the row electrode driver 314. As a result, the LCD panel 312 is driven.

As described above, it is not necessary to prepare a set of orthogonal functions (for example, seven orthogonal functions) by rotating the row vectors of the orthogonal function. It is sufficient to prepare one orthogonal function in the orthogonal function ROM 329. From the orthogonal function, the column vector which becomes an initial value in the sequence 0 may be loaded to the ROT register 330 so that bits are rotated for each divided selection time period (for example, 2-bit rotation). As described above, the initial value in the sequence 0 may be selected based on the update mode.

Although the PpF gradation system is used as a gradation system in the above-described embodiment, it is not limited thereto. The present invention is applicable to any of the PWM gradation system, the FRC gradation system, or a combined system of the PWM gradation system and the FRC gradation system employing divided column voltages as in a conventional example.

As described above, according to this embodiment, the horizontal brightness unevenness peculiar to the MLA drive system can be eliminated to remarkably improve the display quality.

Moreover, since it is sufficient to load the initial value of the column vector of the orthogonal function and to rotate the bits for each divided selection time period when the row vectors of the orthogonal function are rotated, the circuit size for realizing a liquid crystal driving apparatus of the present invention can be remarkably reduced.

Moreover, the number of divided selection time periods is set smaller than the number of orthogonal functions in the orthogonal function set obtained by rotating the row vectors of the orthogonal function, a driving frequency of the column electrodes can be lowered. Therefore, the power consumption can be reduced.

Moreover, in this embodiment, one set of the orthogonal functions is shown. However, different sets of the orthogonal functions can be present.

The multiline addressing drive method and apparatus for passive matrix liquid crystal of the third mode of the present invention are basically constituted as described above.

Although the methods and the apparatus for driving passive matrix liquid crystal of the present invention have been described in detail above with various embodiments, the present invention is not limited to the above embodiments. It is apparent that various modifications or changes may be possible without departing from the scope of the present invention.

INDUSTRIAL APPLICABILITY

As described in detail above, according to the first mode of the present invention, a row electrode selection voltage can be lowered. A relatively large memory necessary for display of 4K colors, 65K colors and the like is incorporated into a fine-process. A row electrode driver and a column electrode driver can be mounted on a single chip, thereby reducing the size of a chip. Moreover, since the number of simultaneously driven row electrodes is as large as 7 or 11, the frame response phenomenon can be prevented even in high-speed liquid crystal having high average response time. As a result, higher contrast can be achieved.

Furthermore, since a voltage amplitude is small, an operation frequency can be lowered, thereby allowing the reduction in power consumption.

As described in detail above, according to the second mode of the present invention, a slow motion picture or a static picture at multi-gradation levels can be displayed in STN liquid crystal while a full motion picture at multi-gradation levels can be displayed with less flicker. In this regard, since a row selection time period is sufficiently long and a frequency at which a column electrode voltage is varied is low, the STN liquid crystal panel can respond thereto, thereby achieving less reduction in contrast.

Moreover, since an operation frequency can be gradually decreased, the power consumption is remarkably small. In full motion picture display, it is possible to restrain the increase in power consumption.

Furthermore, in the case where a region where a full motion picture is to be displayed is arbitrarily designated, the present invention is compatible with various applications. Since the FRC gradation display can be stopped, the present invention has an effect that the splicing is reduced and the reduction in color reproducibility due to incompletion of the MLA calculation is less.

Furthermore, as described above in detail, according to the third mode of the present invention, the horizontal brightness unevenness peculiar to the MLA drive system can be eliminated so as to improve the display quality. Moreover, it is possible to reduce the circuit scale and the power consumption.

The invention claimed is:

1. A method of driving passive matrix liquid crystal composed of a plurality of row electrodes and column electrodes, comprising the steps of:

expressing an upper bit of gradation data corresponding to display data by a pulse width modulation gradation system while expressing a lower bit of the gradation data corresponding to the display data by a frame rate control gradation system; and allocating the representation by the frame rate control gradation system to minimum divided time periods in the pulse width modulation gradation system to add the frame rate control gradation system to the pulse width modulation gradation system.

2. The method of driving passive matrix liquid crystal according to claim 1, wherein a selection time period for selecting the row electrodes is set to an upper bit of data of a larger number of gradations than the maximum gradations to be displayed, thereby mapping each gradation.

3. The method of driving passive matrix liquid crystal according to claim 1, wherein a lower bit of gradation data corresponding to the display data is set to 3 bits, and a selection time period for selecting the row electrodes is set to a multiple of 8, thereby mapping each gradation.

4. The method of driving passive matrix liquid crystal according to claim 1, wherein the passive matrix liquid crystal is driven by a multiline addressing drive system for simultaneously selecting a plurality of row electrodes from the row electrodes for driving.

5. The method of driving passive matrix liquid crystal according to claim 4, wherein the multiline addressing drive system performs an exclusive OR between ON/OFF display data based on the gradation data of simultaneously selected rows and a row electrode selection pattern for each of the minimum divided time periods and adds the results.

6. The method of driving passive matrix liquid crystal according to claim 1, wherein positions of ON based on the gradation data are distributed within a selection time period for selecting the row electrodes, in the pulse width modulation gradation system.

7. The method of driving passive matrix liquid crystal according to claim 6, wherein the positions of ON based on the gradation data are distributed in two, within the selection time period for selecting the row electrodes.

8. The method of driving passive matrix liquid crystal according to claim 1, wherein a frame rate control fixed area for stopping frame rate control is arbitrarily designated in the frame rate control gradation system.

9. The method of driving passive matrix liquid crystal according to claim 8, wherein a frame rate control interval is fixed to the uppermost bit among lower bits of the gradation data within the frame rate control fixed area.

10. A liquid crystal driving apparatus for driving super twisted nematic liquid crystal by a method of driving passive matrix liquid crystal composed of a plurality of row electrodes and column electrodes, said method comprising the steps of:

expressing an upper bit of gradation data corresponding to display data by a pulse width modulation gradation system while expressing a lower bit of the gradation data corresponding to the display data by a frame rate control gradation system; and allocating the representation by the frame rate control gradation system to minimum divided time periods in the pulse width modulation gradation system to add the frame rate control gradation system to the pulse width modulation gradation system.

* * * * *